US011293069B2

(12) United States Patent
Oda et al.

(10) Patent No.: US 11,293,069 B2
(45) Date of Patent: Apr. 5, 2022

(54) METHOD FOR OXYGEN-BLOWING REFINING OF MOLTEN IRON AND TOP-BLOWING LANCE

(71) Applicant: JFE Steel Corporation, Tokyo (JP)

(72) Inventors: Nobuhiko Oda, Tokyo (JP); Goro Okuyama, Tokyo (JP); Shota Amano, Tokyo (JP); Kenji Nakase, Tokyo (JP); Yukio Takahashi, Tokyo (JP); Yuta Hino, Tokyo (JP); Naoki Kikuchi, Tokyo (JP); Yuji Miki, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 87 days.

(21) Appl. No.: 16/955,214

(22) PCT Filed: Nov. 8, 2018

(86) PCT No.: PCT/JP2018/041438

§ 371 (c)(1),
(2) Date: Jun. 18, 2020

(87) PCT Pub. No.: WO2019/123873

PCT Pub. Date: Jun. 27, 2019

(65) Prior Publication Data

US 2020/0392592 A1 Dec. 17, 2020

(30) Foreign Application Priority Data

Dec. 22, 2017 (JP) ..... JP2017-246155

(51) Int. Cl.
*C21C 5/46* (2006.01)
*C21C 5/32* (2006.01)

(52) U.S. Cl.
CPC ..... *C21C 5/4606* (2013.01); *C21C 5/32* (2013.01)

(58) Field of Classification Search
None
See application file for complete search history.

(56) References Cited

U.S. PATENT DOCUMENTS 5,919,282 A 7/1999 Hoshijima et al.
6,017,380 A 1/2000 Kitamura et al.
(Continued)

FOREIGN PATENT DOCUMENTS

CN 1164873 A 11/1997
CN 1168157 A 12/1997
(Continued)

OTHER PUBLICATIONS

International Search Report and Written Opinion for International Application No. PCT/JP2018/041438, dated Jan. 29, 2019, 4 pages.
(Continued)

*Primary Examiner* — Scott R Kastler
(74) *Attorney, Agent, or Firm* — RatnerPrestia

(57) ABSTRACT

In a method for oxygen-blowing refining of molten iron, an oxygen-containing gas as a main supply gas is supplied from an inlet side of a blowing nozzle for the oxygen-containing gas passing through an outer shell of the top-blowing lance and blown from the blowing nozzle while a control gas is jetted toward inside of the blowing nozzle for at least part of a period of the oxygen-blowing refining from a spout arranged in a side face of the nozzle at a site where the cross-sectional area of the nozzle minimum takes the minimum in the axial direction of the nozzle or a neighborhood thereof so that at least part of the spout exists in each space formed by dividing into two portions by an arbitrary plane passing through a central axis of the nozzle.

14 Claims, 6 Drawing Sheets

(56) References Cited

U.S. PATENT DOCUMENTS

| | | | | |
|---|---|---|---|---|
| 2003/0010155 | A1 | 1/2003 | Sumi et al. | |
| 2015/0344982 | A1* | 12/2015 | Ha | F27D 3/16 75/553 |
| 2020/0392592 | A1* | 12/2020 | Oda | C21C 5/32 |

FOREIGN PATENT DOCUMENTS

| | | | |
|---|---|---|---|
| CN | 13956522 | A | 2/2003 |
| JP | 08260029 | A | 10/1996 |
| JP | 08269530 | A | 10/1996 |
| JP | 2000234116 | A | 8/2000 |
| JP | 2001220817 | A | 8/2001 |
| JP | 2004156083 | A | 6/2004 |
| JP | 2006070292 | A | 3/2006 |
| JP | 2007077489 | A | 3/2007 |
| JP | 2011074411 | A | 4/2011 |
| TW | 201130989 | A | 9/2011 |
| WO | 2010076214 | A1 | 7/2010 |
| WO | 2019123873 | A1 | 6/2019 |

OTHER PUBLICATIONS

Japanese Office Action for Japanese Application No. 2019-506455, dated Nov. 13, 2019, 4 pages.

Taiwanese Office Action for Taiwanese Application No. 107146085, dated May 1, 2019, 7 pages.

Chinese Office Action for Chinese Application No. 201880080103.X, dated Jun. 29, 2021 with English Search Report, 13 pages.

Extended European Search Report for European Application No. 18 893 243.8, dated Jan. 13, 2021, 7 pages.

Korean Office Action for Korean Application No. 10-2020-7017434, dated Aug. 19, 2021, 8 pages.

* cited by examiner

Number of spout for control gas:
2

Number of spout for control gas:
4

Number of spout for control gas:
8

Number of spout for control gas:
1 (slit-like form)

METHOD FOR OXYGEN-BLOWING REFINING OF MOLTEN IRON AND TOP-BLOWING LANCE

CROSS REFERENCE TO RELATED APPLICATIONS

This is the U.S. National Phase application of PCT/JP2018/041438, filed Nov. 8, 2018, which claims priority to Japanese Patent Application No 2017-246155, filed Dec. 22, 2017, the disclosures of these applications being incorporated herein by reference in their entireties for all purposes.

FIELD OF THE INVENTION

This invention relates to a method for oxygen-blowing refining of molten iron by blowing an oxygen-containing gas from a top-blowing lance to the molten iron charged in a reaction vessel to perform oxygen-blowing refining of molten iron, and a top-blowing lance used for the oxygen-blowing refining.

BACKGROUND OF THE INVENTION

In oxidation refining of molten iron, it is demanded to use a practical oxygen-blowing means capable of simultaneously controlling a blowing rate and a blowing amount of an oxygen-containing gas blown from a top-blowing lance onto a bath surface of the molten iron from a viewpoint of improving reaction efficiency.

For example, decarburization refining of molten pig iron in a converter may be operated by increasing the amount of top-blown oxygen per unit time from a viewpoint of improving the productivity. However, when the blowing rate at a bath surface of the molten pig iron becomes higher, an iron content which is dispersed toward outside of the converter as dust and an iron content adhered/deposited onto the wall of the converter or near an opening port of the converter are increased. As the content becomes larger, increase in cost due to the decrease of iron yield and decrease in the operation availability of the converter are caused. Therefore, it is demanded to provide an oxygen-blowing means capable of attaining an operation with a large blowing amount and a low blowing rate.

On the other hand, when a carbon concentration in molten iron is low at the last stage of blowing, it is common to conduct the blowing by decreasing the amount of the top-blown oxygen to prevent an excessive oxidation loss of iron. In this case, when the blowing rate at the bath surface of molten iron is too low, there is caused a problem that the agitation of the molten iron at a hot spot becomes weak to excessively oxidize iron. Therefore, it is demanded to provide an oxygen blowing means capable of conducting the operation at a low blowing rate when the oxygen-blowing amount is large while conducting the operation at a high blowing rate even when the oxygen blowing amount is small.

In general, a method of adjusting a lance height is used to adjust the blowing rate at the bath surface irrespectively of the adjustment of the oxygen-blowing amount. However, when the lance height is too low, there is caused a problem that the service life of the lance is considerably decreased due to erosion by flying molten iron, while when the lance height is too high, there is also caused a problem that the gas temperature inside the converter is raised by increase in a secondary combustion rate or decrease in a secondary combustion heat efficiency to bring about decrease in refractory service life. Thus, the adjustment range of the blowing rate by the lance height is limited. Therefore, it is expected to provide an oxygen blowing nozzle capable of adjusting the blowing rate irrespectively of the oxygen-blowing amount.

In general, the gas blowing rate at an outlet of the nozzle is unambiguously determined depending on the gas blowing amount where the form of the nozzle is decided, and there is a nature that the blowing rate is increased when the blowing amount is large while the blowing rate is decreased when the blowing amount is small. In particular, there has been a problem that the blowing rate is excessively lowered when the gas blowing amount is decreased, as a result of increasing the nozzle size to attain a low kinetic pressure at a large gas blowing amount. Therefore, examinations have been made on a technique capable of simultaneously attaining both blowing conditions that the kinetic pressure is not too much increased when the oxygen blowing amount is large and that the kinetic pressure is not too much decreased when the oxygen blowing amount is small, by controlling the nozzle form during the blowing. As a technique of controlling the nozzle form during the blowing, for example, Patent Literature 1 discloses a technique of a top-blowing lance that mechanically changes the nozzle form inside a vacuum degassing tank.

Patent Literature 2 discloses an operation method using a Laval nozzle that a gas blowoff hole is disposed in an inner face of a widened portion of the Laval nozzle to blow gas from the blowing hole in accordance with the oxygen gas blowing amount as a main stream. Such a Laval nozzle, which enables a gas pressure to be converted into a kinetic energy efficiently, is widely used in converter refining so as to obtain a sufficient gas blowing rate at the bath surface of the molten iron even when the lance height is made higher. In the Laval nozzle, a pressure ratio between the inlet and the outlet of the nozzle is determined such that an adequate expansion is attained at the widened portion of the nozzle to decrease energy loss in accordance with a ratio (opening ratio) of cross-sectional area between the outlet and the throat portion in the nozzle (area of cross section perpendicular to a central axis in the nozzle). Since the pressure at the outlet of the nozzle inside the converter is approximately atmospheric pressure, the gas pressure at the inlet of the nozzle that provides an adequate expansion in accordance with the nozzle form (adequate expansion pressure) and the gas blowing amount (adequate expansion blowing amount) in response thereto are unambiguously determined. However, when the gas blowing amount is decreased lower than the adequate expansion blowing amount, the gas pressure at the inlet of the nozzle is lowered than the adequate expansion pressure, causing an excessively expanded state in which a shock wave is generated in the inside of the nozzle. On the other hand, when the gas blowing amount is increased higher than the adequate expansion blowing amount, an insufficient expansion state in which a shock wave is generated in the outside of the outlet of the nozzle is caused to lead energy loss, so that the gas blowing rate is lowered with respect to each gas pressure as compared to the nozzle form providing the adequate expansion.

In the method of Patent Literature 2, when the gas blowing amount is lower than the adequate expansion blowing amount, a small amount of gas is blown from the blowing hole disposed in inner face of the widened portion of the Laval nozzle to thereby push inward and peel off the gas stream in a boundary layer which is formed along a side face of the widened portion in the nozzle. Thus, the expansion of the mainstream gas is suppressed to mitigate the excessively expanded state, and hence it is possible to suppress the decrease in the gas blowing rate caused when the gas blowing amount is decreased.

As a method of controlling a gas jet by blowing a gas other than a mainstream gas jet into the nozzle, Patent Literature 3 discloses a method wherein the jetting direction of the mainstream gas jet is controlled by jetting an activating gas to a throat portion of a Laval nozzle in a top-blowing lance of a RH degassing apparatus.

PATENT LITERATURE

Patent Literature 1: JP-A-H08-260029
Patent Literature 2: JP-A-2000-234116
Patent Literature 3: JP-A-2004-156083

SUMMARY OF THE INVENTION

The method of Patent Literature 1, in which the nozzle form is mechanically changed, is not practical in a point that a mechanically movable part is provided at a high temperature and under an atmosphere where dust is generated, and also has a problem that it is hardly applicable to a lance having many blowing holes. Also, when the cross-sectional area is decreased by the movable part in the inner face of the nozzle, a level difference is generated in a stepwise portion, but the influence of such a level difference upon the gas blowing rate is not completely clear.

The method of Patent Literature 2 intends to peel off the boundary layer of the blown gas from the wall face of the nozzle in the widened portion of the Laval nozzle to mitigate the excessively expanded state when the gas blowing amount is small, but has a problem that the blowing rate cannot be increased effectively under a poor expansion condition that the gas supplying pressure is higher than the adequate expansion pressure determined by the opening ratio of the nozzle.

In order to improve the productivity in oxygen-blowing refining in the converter or the like, it is particularly demanded to increase the blowing amount of oxygen gas, and the cross-sectional area of the nozzle in the throat portion may be expanded in order to suppress the gas blowing rate under a large gas blowing amount condition. However, since it is necessary to ensure an adequate cross-sectional area of a pathway of a cooling water for cooling the leading end of the lance, the cross-sectional area at the outlet of the nozzle is limited, and thus the opening ratio of the nozzle cannot be set entirely freely. In this case, the opening ratio of the nozzle and the adequate expansion pressure determined thereby tend to decrease, causing a poor expansion condition even in a low gas blowing amount condition. In the method of Patent Literature 2, however, the gas blowing rate cannot be increased effectively in such a case.

In the method of Patent Literature 3, the jetting direction of the gas jet can be controlled, but there is a problem that the gas blowing rate cannot be controlled effectively.

An object according to aspects of the invention is to provide a method of top-blowing oxygen having a large variable range of a gas blowing amount, wherein a gas blowing rate can be increased effectively when the gas blowing amount is small even under a poor expansion condition without using a mechanically movable part in a lance nozzle, and a top-blowing lance used therefor.

In order to solve the above task, the inventors have made various studies on a method of controlling a gas blowing rate irrespectively of a gas blowing amount by changing a technique of introducing a gas into a nozzle without arranging a mechanically movable part in a blowing nozzle for a top-blown gas, and as a result, developed a method for oxygen-blowing refining according to aspects of the invention and a top-blowing lance used for such an oxygen-blowing refining.

That is, aspects of the invention include a method for oxygen-blowing refining of molten iron by blowing an oxygen-containing gas from a top-blowing lance to molten iron charged in a reaction vessel to conduct oxygen-blowing refining of the molten iron, characterized in that the oxygen-containing gas as a main supply gas is supplied from an inlet side of a blowing nozzle for the oxygen-containing gas passing through an outer shell of the top-blowing lance and blown from the blowing nozzle while a control gas is jetted toward inside of the blowing nozzle for at least a part of a period of the oxygen-blowing refining from a spout arranged in a side face of the nozzle at a site where a cross-sectional area of the nozzle takes the minimum in the axial direction of the nozzle or a neighborhood thereof so that at least a part of the spout exists in each space formed by dividing the nozzle into two by an arbitrary plane passing through a central axis of the nozzle. As a preferable embodiment, the neighborhood of the site where the cross-sectional area of the nozzle takes the minimum in the axial direction of the nozzle is a site where the cross-sectional area of the nozzle is not more than 1.1 times of the minimum cross-sectional area in the axial direction of the nozzle.

In accordance with aspects of the invention, "cross-sectional area" of the nozzle means an area perpendicular to the central axis inside the nozzle through the whole of the description. Thus, the "a site where the cross-sectional area of the nozzle is not more than 1.1 times of the minimum cross-sectional area" means a site where the cross-sectional area of the site is more than 1.0 times but not more than 1.1 times of the minimum cross-sectional area.

In the method for oxygen-blowing refining of molten iron according to aspects of the invention having the above configuration, the followings are considered to be preferable solution means:

(1) as the blowing nozzle is used a straight nozzle having a straight portion continuous to the outlet of the nozzle where the cross-sectional area is minimum and constant in the axial direction of the nozzle or a Laval nozzle having a widened portion continuous to a throat portion where the cross-sectional area takes the minimum in the axial direction of the nozzle;

(2) a pressure of the main supply gas at the inlet side of the blowing nozzle is made larger than an adequate expansion pressure Po satisfying the following equation (1):

$$Ae/At=(5^{5/2}/6^3)\times(Pe/Po)^{-5/7}\times[1-(Pe/Po)^{2/7}]^{-1/2} \quad (1),$$

wherein At is a minimum cross-sectional area of the blowing nozzle ($mm^2$), Ae is a cross-sectional area of an outlet of the blowing nozzle ($mm^2$), Pe is a pressure in an atmosphere at an outlet of the nozzle (kPa), and Po is an adequate expansion pressure of the nozzle (kPa);

(3) the spout is arranged at plural places in a side face of the blowing nozzle in a circumferential direction thereof and a product of a diameter of an introduction hole for the control gas toward the spout and the number of the spouts n per one blowing nozzle is not less than 0.4 times of an inner diameter of the nozzle at the site where the cross-sectional area of the blowing nozzle takes the minimum;

(4) the spout is arranged in a slit-like form over the whole circumferential direction at a side face of the blowing nozzle and a length of the spout in the axial direction of the blowing nozzle is not more than 0.25 times of an inner diameter of the nozzle at the site where the cross-sectional area of the blowing nozzle takes the minimum;

(5) the amount of the control gas jetted toward inside of the blowing nozzle for at least part of a period of the oxygen-blowing refining is not less than 5% of a total amount of the control gas and the main supply gas supplied to the blowing nozzle;

(6) the supply rate of the control gas is adjusted in accordance with the supply rate of the oxygen-containing gas to be blown from the top-blowing lance to the molten iron;

(7) the supply rate of the control gas is varied with the progression of the oxygen-blowing refining of the molten iron;

(8) the supply rate of the control gas is varied in accordance with a silicon concentration in the molten iron before the start of the oxygen-blowing refining;

(9) the oxygen-containing gas is supplied as the main supply gas while the control gas is jetted in the blowing nozzle at a last stage of the oxygen-blowing refining after the supply of 85% of a total oxygen gas amount in the oxygen-containing gas supplied in the oxygen-blowing refining;

(10) the oxygen-containing gas is supplied as the main supply gas to the molten iron having a silicon concentration of not less than 0.40 mass % before the start of the oxygen-blowing refining while the control gas is jetted in the blowing nozzle at an initial stage of the oxygen-blowing refining before the supply of 20% of a total oxygen gas amount contained in the oxygen-containing gas supplied in the oxygen-blowing refining.

Further, aspects of the invention include a top-blowing lance for blowing an oxygen-containing gas to molten iron charged in a reaction vessel, characterized in that a blowing nozzle for the oxygen-containing gas is provided so as to pass through an outer shell of the top-blowing lance; a spout for jetting a control gas toward inside the blowing nozzle is arranged in a side face of the nozzle at a site where a cross-sectional area of the nozzle takes the minimum in the axial direction of the nozzle or a neighborhood thereof in such a manner that at least part of the spout exists in each space formed by dividing the nozzle into two by an arbitrary plane passing through a central axis of the nozzle; and introduction pathways for the control gas into plural spouts for the control gas arranged in plural directions in the circumferential direction of a side face of the nozzle are communicated to each other in the top-blowing lance. In a preferable embodiment, the neighborhood of the site where the cross-sectional area of the nozzle takes the minimum in the axial direction of the nozzle is a site where the cross-sectional area of the nozzle is not more than 1.1 times of the minimum cross-sectional area in the axial direction of the nozzle.

In the top-blowing lance having the above configuration according to aspects of the invention, the followings are considered to be preferable solution means:

(1) the spout is arranged at plural places in the side face of the blowing nozzle in a circumferential direction thereof and the product of an inner diameter of a jetting nozzle for the control gas communicating with the spout and number of the spouts n per one blowing nozzle is not less than 0.4 times of an inner diameter of the nozzle corresponding to the minimum cross-sectional area of the blowing nozzle;

(2) as the blowing nozzle is used a straight nozzle having a straight portion continuous to the outlet of the nozzle where the cross-sectional area is minimum and constant in the axial direction of the nozzle or a Laval nozzle having a widened portion continuous to a throat portion where the cross-sectional area takes the minimum in the axial direction of the nozzle.

Furthermore, aspects of the invention include a top-blowing lance for blowing an oxygen-containing gas to molten iron charged in a reaction vessel, characterized in that a blowing nozzle for the oxygen-containing gas is provided so as to pass through an outer shell of the top-blowing lance, and a spout for jetting a control gas toward inside the blowing nozzle is arranged in a slit-like form over the whole circumferential direction at a side face of the blowing nozzle at a site where a cross-sectional area of the nozzle takes the minimum in the axial direction of the nozzle or a neighborhood thereof. As a preferable embodiment, the neighborhood of the site where the cross-sectional area of the nozzle takes the minimum in the axial direction of the nozzle is a site where the cross-sectional area of the nozzle is not more than 1.1 times of the minimum cross-sectional area in the axial direction of the nozzle.

In the top-blowing lance having the above configuration according to aspects of the invention, the followings are considered to be preferable solution means:

(1) a length of the spout in the axial direction of the blowing nozzle is not more than 0.25 times of an inner diameter of the blowing nozzle corresponding to the minimum cross-sectional area of the nozzle.

(2) as the blowing nozzle is used a straight nozzle having a straight portion continuous to the outlet of the nozzle where the cross-sectional area is minimum and constant in the axial direction of the nozzle or a Laval nozzle having a widened portion continuous to a throat portion where the cross-sectional area takes the minimum in the axial direction of the nozzle.

According to aspects of the invention, it is possible to control the gas blowing rate irrespectively of the total gas blowing amount by controlling the control gas jetted toward inside of the blowing nozzle from plural directions in the circumferential direction or from the whole circumferential direction at the side face of the nozzle in the neighborhood of the site where the cross-sectional area of the nozzle takes the minimum without using the mechanically movable part in the blowing nozzle for the oxygen-containing gas in the top-blowing lance. Thus, the operation can be performed without causing troubles in the mechanically movable part even under such an oxygen-blowing refining condition that molten iron or the like largely flies. The gas blowing rate when the gas blowing amount is small can be increased effectively even under a poor expansion condition, so that there can be attained a top-blowing method of oxygen having a large variable range of a gas blowing amount and a top-blowing lance used therefor. That is, even when using a nozzle being large in the minimum inner diameter suitable for reduction of spitting at a condition of a high gas blowing amount, it is possible to conduct oxygen-blowing refining by suppressing decrease in the gas blowing rate under the condition of the small gas blowing amount.

DETAILED DESCRIPTION OF EMBODIMENTS OF THE INVENTION

An embodiment of the invention will be described with reference to the drawings.

Figure 1:
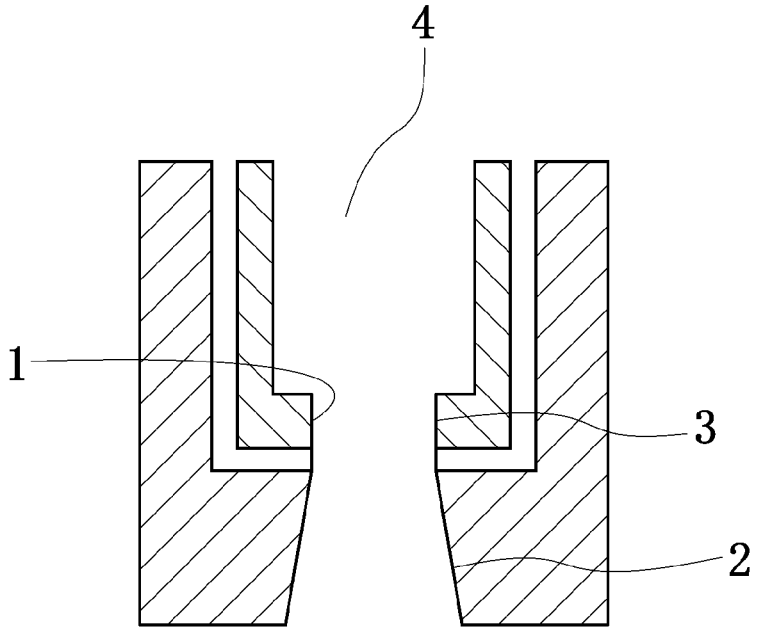
FIG. 1 is a schematic view illustrating a longitudinal section of an example of a gas blowing nozzle used in a top-blowing lance according to aspects of the invention.
Figure 2A:
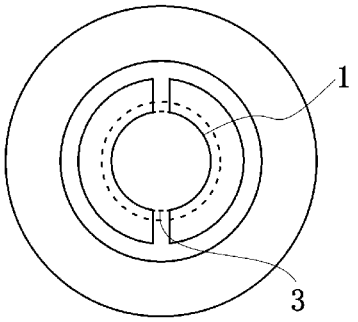
FIGS. 2(*a*) to (*d*) are schematic views of a cross section at a throat portion illustrating a spout for control gas in the gas blowing nozzle shown in FIG. 1.
Figure 2B:
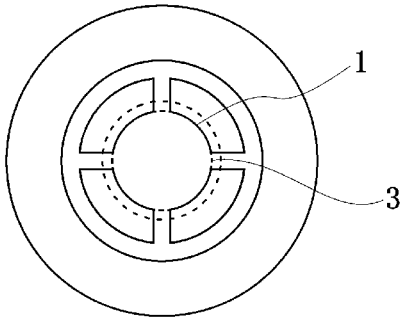
Figure 2C:
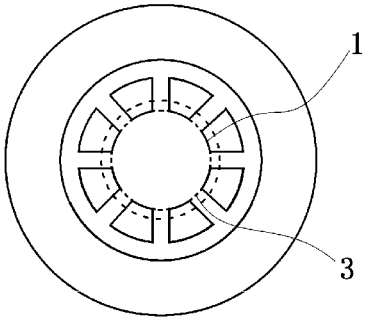
Figure 2D:
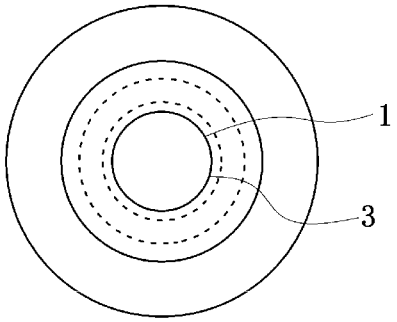

FIG. 1 is a schematic view illustrating a longitudinal section of an example of a gas blowing nozzle for a top-blowing lance used in accordance with aspects of the invention. An oxygen-containing gas for oxygen-blowing refining is blown from an air storage tank 4 of the top-blowing lance through a blowing nozzle passing through an outer shell of the top-blowing lance onto a bath surface. In examples illustrating FIG. 1 and FIGS. 2(*a*) to (*d*) is shown a top portion of the top-blowing lance having only one blowing nozzle to simplify the description, in which a pathway for cooling water and the like in an outer shell of the top-blowing lance are omitted. As the oxygen-containing gas is usually used an industrially pure oxygen gas, but a mixed gas of the pure oxygen gas and a nitrogen gas or an argon gas may be used depending on the purpose thereof.

The Laval nozzle shown in FIG. 1 comprises a throat portion 1 where the cross-sectional area inside the nozzle takes the minimum in the axial direction of the blowing nozzle and a widened portion 2 extending downstream from the throat portion 1. Also, a tapered portion (not shown) may be provided extending upstream from the throat portion 1 to provide a tapered and widened nozzle form for introducing a main supply gas into the throat portion 1. The top-blowing lance used in accordance with aspects of the invention is provided with a gas blowing nozzle having a spout 3 for control gas disposed such that at least part of the spout exists in each space formed by dividing the nozzle into two by an arbitrary plane passing through a central axis of the nozzle at a side face of the nozzle in the neighborhood of a site where the cross-sectional area of the nozzle takes the minimum in the axial direction of the blowing nozzle. It is possible to supply the oxygen-containing gas as a main supply gas from an inlet side of the blowing nozzle while jetting the control gas capable of controlling the jetting amount independently of the main supply gas, which is supplied from the inlet of the blowing nozzle, toward inside of the blowing nozzle through the spout 3 for the control gas.

Here, the cross-sectional area of the blowing nozzle at the site including the spout 3 means an area enclosed by a virtual nozzle side face, which is a curved face on the side face of the blowing nozzle formed by interpolating a portion of the spout 3 actually having no side face of the blowing nozzle by a smooth curved face continuing from the nozzle side face around the spout 3, in a plane perpendicular to the central axis of the blowing nozzle.

In this case, when the side face of the blowing nozzle excluding the portions of the plural spouts 3 is formed as a side face of a rotating body centering on the central axis of the blowing nozzle, the virtual nozzle curved face corresponds to the side face of the rotating body. In the case of the Laval nozzle, the curved face interpolating the portion of the spout 3 frequently comprises a part of a side face of a circular cylinder, a circular cone, or a combination thereof, but is not necessarily limited to a part of the circular cylinder, circular cone or a combination thereof, when considering that the form of the widened portion 2 may not be a circular cone shape but a bell shape or the sectional form of the blowing nozzle is not circular.

When the spout 3 is formed in a slit-like form in the whole circumferential direction of the blowing nozzle as mentioned later, the virtual nozzle curved face is determined by interpolating the site of the spout 3 in the section inclusive of the central axis of the blowing nozzle by a smooth curved line continuing to the side face of the nozzle in the vicinity thereof (including a straight line).

In a top-blowing lance having a usual Laval nozzle for top-blowing an oxygen gas with no spout 3 thereon, it is experientially known that a relation between a blowing amount of oxygen gas and a pressure at an inlet of the throat portion is approximately represented by the following equation (2):

$$Pt=F_{O2}/(0.456\times n\times dt^2) \quad (2),$$

wherein Pt is a gas pressure at the inlet of the throat portion 1 (absolute pressure) (kgf/cm$^2$), Foe is a blowing amount of oxygen gas blown from the top-blowing lance (Nm$^3$/hr), n is the number of the blowing nozzles in the top-blowing lance, and dt is an inner diameter of the throat portion in the blowing nozzle.

As seen from the equation (2), the gas pressure Pt at the inlet of the throat portion 1 is proportional to the blowing amount of the gas and inversely proportional to the cross-sectional area of the throat portion 1 (or Pt is proportional to a linear velocity (Nm/s) of the gas). The gas jet blowing from the blowing nozzle fundamentally utilizes the gas pressure Pt as a power source, and there is a tendency that the blowing rate or kinetic energy of the gas jet becomes qualitatively higher as the gas pressure Pt becomes higher.

On the contrary, when the control gas is jetted from the spout 3 under a condition that the total gas blowing amount from the blowing nozzle is constant, a zone having a small mass flux in the axial direction is generated in the vicinity of the spout 3 in the throat portion 1, and the mass flux (mass flow rate per unit area) is increased in a zone other than a cross section of the throat portion 1 (section perpendicular to the central axis of the blowing nozzle) as compared to the case that the control gas is not jetted. Thus, the gas pressure of the main supply gas is increased at the inlet of the throat portion 1, and there is a phenomenon that the blowing rate of the gas jet blown from the blowing nozzle is increased. Such a phenomenon can be said to be an effect of apparently decreasing the cross-sectional area of the throat portion 1, but is remarkable even when the ratio of the control gas to the main supply gas is relatively small and is observed even when the spout for control gas is disposed in a certain position in the axials direction not only in the Laval nozzle provided with the spout 3 for control gas in the throat portion 1 but also in the straight nozzle having a constant cross-sectional area in the axial direction of the nozzle. In the straight nozzle having no widened portion 2, when the positions for providing plural spouts 3 in the axial direction of the nozzle are equable to any spout 3, they may be disposed in arbitrary positions in the axial direction of the nozzle. That is, the position for disposing the spout 3 in the straight nozzle is a side face of the nozzle at a site where the cross-sectional area of the nozzle takes the minimum in the axial direction of the nozzle.

In order to efficiently convert the increase in the gas pressure of the main supply gas at the inlet of the throat portion by the introduction of the control gas from the spout 3 to kinetic energy so as to increase the blowing rate, it is necessary to consider the influence of the nozzle form similarly when the usual Laval nozzle is used. The inventors have found that the effect of increasing the preferable blowing rate is particularly obtained under the condition of a specified nozzle form. That is, the blowing rate can be increased effectively under such an apparently poor expansion condition that a gas pressure at the inlet of the throat portion for the main supply gas is higher than an adequate expansion pressure Po determined by the following equation (1) with respect to an opening ratio of the blowing nozzle (Ae/At) as compared to the case that the above condition is not satisfied:

$$Ae/At=(5^{5/2}/6^3)\times(Pe/Po)^{-5/7}\times[1-(Pe/Po)^{2/7}]^{-1/2} \quad (1),$$

wherein At is a minimum cross-sectional area of the blowing nozzle ($mm^2$), Ae is a cross-sectional area at an outlet of the blowing nozzle ($mm^2$), Pe is a pressure of an atmosphere at the outlet of the nozzle (kPa), and Po is an adequate expansion pressure of the nozzle (kPa). The influence of the nozzle form upon the effect of increasing the blowing rate is considered as follows.

In the usual Laval nozzle, when the gas pressure at the inlet of the throat portion 1 is higher than the adequate expansion pressure, poor expansion is caused in the widened portion 2 of the Laval nozzle, and the gas is blown from the outlet of the nozzle with keeping a high pressure and expanded together with a shock wave outside the nozzle to generate energy loss, and hence the blowing rate is lowered as compared to a case of a nozzle having a larger opening ratio that attains the adequate expansion at a gas pressure in the same inlet of the throat portion 1.

On the other hand, when the control gas is blown from the plural spouts 3 disposed on the nozzle side face of the throat portion 1 (or a straight portion where the cross-sectional area of the nozzle takes the minimum in the axial direction of the nozzle), a gas boundary layer of the main supply gas formed along the nozzle side face (wall face) of the throat portion 1 is peeled off from the nozzle side face to cause an effect of apparently decreasing the cross-sectional area of the nozzle at the throat portion 1. The effect of decreasing the cross-sectional area of the nozzle is considered to be made relatively small by accelerating the control gas in the gas blowing direction of the blowing nozzle at the outlet of the nozzle. Therefore, the effect of substantially increasing the opening ratio as compared to the actual nozzle form is caused by introducing the control gas, and the adequate expansion is substantially caused at the gas pressure at the inlet of the throat portion 1, which is higher than the adequate expansion pressure determined from the nozzle form (opening ratio) by using the equation (1) to increase the blowing rate. Also, when a nozzle having an opening ratio determined from the gas pressure at the inlet of the throat portion 1 by using the equation (1), overexpansion is substantially caused to cause energy loss. Thus, when the control gas is jetted from the plural spouts disposed on the nozzle side face of the throat portion 1 (or the site where the cross-sectional area of nozzle takes the minimum in the axial direction of the nozzle), the blowing rate can be increased effectively under an apparently poor expansion condition that the gas pressure of the main supply gas at the inlet of the throat portion 1 is higher than the adequate expansion pressure Po determined from the form of the blowing nozzle (opening ratio) by using the equation (1), as compared to the case that the above condition is not satisfied.

In order to confirm the function of increasing the blowing rate by the control gas as mentioned above, a model experiment is conducted by using a nozzle of a form as shown in FIG. 1 to examine an influence of the control gas upon the blowing rate. The conditions of the nozzle form used are shown in Table 1, wherein nozzles A1 to A3 and B are Laval nozzles having a throat portion 1, and nozzles C1 to C6 are straight nozzles having a spout for control gas located at a predetermined distance from an outlet of the nozzle. As the spout for the control gas, 8 spouts are arranged at equal intervals in the circumferential direction in any form condition, as shown by a cross-sectional view of the throat of the blowing nozzle in FIG. 2(*c*), and formed as an open end in an introduction hole having an inner diameter of 1 mm (introduction hole for control gas). In C5 and C6, 4 spouts among 8 spouts are closed, and the closed 4 spouts are adjoined to each other in C5, while those are alternately arranged one by one in C6. An area ratio of the spouts for control gas in Table 1 means a ratio of total cross-sectional area of the introduction holes for control gas to the minimum cross-sectional area of each nozzle.

TABLE 1

| Nozzle | A1 | A2 | A3 | B | C1 | C2 | C3 | C4 | C5 | C6 |
|---|---|---|---|---|---|---|---|---|---|---|
| Minimum diameter D1 (mm) | | 5.4 | | 6.6 | | | | 7 | | |
| Outlet diameter De(mm) | | 6 | | 7 | | | | 7 | | |

TABLE 1-continued

| Nozzle | A1 | A2 | A3 | B | C1 | C2 | C3 | C4 | C5 | C6 |
|---|---|---|---|---|---|---|---|---|---|---|
| Length of widened portion(mm) | 4 | | | 6 | | | | — | | |
| Adequate expansion pressure Po(MPa) | 0.41 | | | 0.33 | | | | 0.19 | | |
| Distance from spout for control gas to outlet of nozzle(mm) | 4.0 | 2.7 | 2 | 6 | 3.3 | 5.7 | 16.5 | 20.0 | 5.7 | |
| Diameter of spout for control gas (mm) | 1 | | | 1 | | 1 | | | 1 | |
| Number of spout for control gas (—) | 8 | | | 8 | | 8 | | | 4 (adjacent) | 4 (alternate) |
| Area ratio of spout for control gas | 27% | | | 18% | | 16% | | | 8% | 8% |

High-pressure air is supplied as a main supply gas and a control gas under flowing amount conditions shown in Table 2, and a blowing rate of the gas jet is measured on a central axis 200 mm separated from the nozzle tip to obtain a result shown in Table 2 together with supplying pressures of the main supply gas and the control gas. In this test, a study is made by varying the total gas blowing amount (the total of the main supply gas blowing amount and the control gas jetting amount) in each nozzle within three conditions and comparing a case that the control gas is not supplied and another case that a ratio of the control gas jetting amount to the total gas blowing amount is 20%. Moreover, main forms such as minimum diameter of the nozzle, opening ratio and so on for a model test shown in Table 1 are determined so as to be similar to a scale reduction of about 1/10 of a gas blowing nozzle in an actual top-blowing lance of 300 t as mentioned later. Also, the gas blowing amount in the model test shown in Table 2 is set to about 1/100 of an operating condition range in the actual gas blowing nozzle so as to make a pressure and linear velocity of the gas almost equal to those of the actual operating condition.

from the results of Table 2, it is possible to raise the pressure of the main supply gas and increase the blowing rate by blowing the control gas where the total gas blowing amount is constant. In particular, the effect of increasing the blowing rate is large under a condition that the pressure of the main supply gas exceeds an adequate expansion pressure of each nozzle. This is considered due to the fact that the effect of apparently increasing the opening ratio is caused by blowing the control gas to form a condition relatively close to the adequate expansion.

It can be seen that the increasing effect is obtained irrespectively of the kind of the Laval nozzle and the straight nozzle, when the spouts are formed on the side face of the nozzle at the site where the cross-sectional area of the nozzle takes the minimum (examples of A1, B and C1 to C6) or in the vicinity thereof (examples of A2 and A3), It can be also considered that the effect is not obtained when the control gas is jetted from one direction to the nozzle and thus it is necessary to arrange the spout so that at least a part thereof exists in each space formed by dividing the spout for control gas into two portions by an arbitrary plane passing through the central axis of the nozzle.

TABLE 2

| Control gas | Nozzle | Total gas blowing amount $Nm^3/min$ | Main supply gas blowing amount $Nm^3/min$ | Control gas jetting amount $Nm^3/min$ | Pressure of main supply gas MPa | Pressure of control gas MPa | Blowing gas rate m/s | Differnece of gas blowing rate m/s |
|---|---|---|---|---|---|---|---|---|
| absence | A1~3 | 0.8 | 0.8 | 0 | 0.32 | — | 100 | — |
| | | 1.1 | 1.1 | 0 | 0.45 | — | 110 | — |
| | | 1.4 | 1.4 | 0 | 0 55 | — | 150 | — |
| | B | 1.1 | 1.1 | 0 | 0.29 | — | 90 | — |
| | | 1.4 | 1.4 | 0 | 0.37 | — | 120 | — |
| | C1~4 | 1.1 | 1.1 | 0 | 0.26 | — | 80 | — |
| | | 1.4 | 1.4 | 0 | 0.33 | — | 100 | — |
| presence | A1 | 0.8 | 0.64 | 0.16 | 0.36 | 0.35 | 100 | +0 |
| | | 1.1 | 0.88 | 0.22 | 0.49 | 0.45 | 130 | +20 |
| | | 1.4 | 1.12 | 0.28 | 0.61 | 0.60 | 170 | +20 |
| | A2 | 1.1 | 0.88 | 0.22 | 0.48 | 0.40 | 120 | +10 |
| | A3 | 1.1 | 0.88 | 0.22 | 0.45 | 0.30 | 110 | +0 |
| | B | 1.1 | 0.88 | 0.22 | 0.34 | 0.40 | 120 | +30 |
| | | 1.4 | 1.12 | 0.28 | 0.43 | 0.51 | 150 | +30 |
| | C1 | 1.1 | 0.88 | 0.22 | 0.33 | 0.41 | 110 | +30 |
| | C2 | 1.1 | 0.88 | 0.22 | 0.33 | 0.42 | 120 | +40 |
| | | 1.4 | 1.12 | 0.28 | 0.41 | 0.51 | 150 | +50 |
| | C3 | 1.1 | 0.88 | 0.22 | 0.33 | 0.42 | 110 | +30 |
| | C4 | 1.1 | 0.88 | 0.22 | 0 33 | 0.42 | 110 | +30 |
| | C5 | 1.1 | 0.88 | 0.22 | 0.28 | 0.72 | 80 | +0 |
| | C6 | 1.1 | 0.88 | 0.22 | 0.35 | 0.79 | 100 | +20 |

The difference of gas blowing rate in Table 2 is a difference of a gas blowing rate depending on the presence and absence of the control gas in the same data conditions of the nozzle form and total gas blowing amount. As seen Here, the "site where the cross-sectional area of the nozzle takes the minimum" is examined with reference to A1 to A3 using the Laval nozzle in Tables 1 and 2. First, the position arranged with the spout in A1 is found to be the throat portion 1 where the cross-sectional area of the nozzle takes the minimum in the axial direction, because the length of the widened portion is 4 mm and the distance of the spout for control gas from the outlet of the nozzle is 4 mm. Also, the position arranged with the spout in A2 is found to be the site where the cross-sectional area of the nozzle is 1.06 times of the minimum cross-sectional area in the axial direction of the nozzle, because the length of the widened portion is 4 mm and the distance of the spout for control gas from the outlet of the nozzle is 2.7 mm. Furthermore, the position arranged with the spout in A3 is found to be the site where the cross-sectional area of the nozzle is 1.14 times of the minimum cross-sectional area in the axial direction of the nozzle, because the length of the widened portion is 4 mm and the distance of the spout for control gas from the outlet of the nozzle is 2 mm. When "difference of gas blowing rate m/s" in A1 to A3 of Table 2 is compared under the condition that the total gas blowing amount is 1.1 $Nm^3$/min in the presence of the control gas, nozzle A1 having a scale factor to the minimum cross-sectional area of "1" is +20 m/s, and nozzle A2 having a scale factor to the minimum cross-sectional area of "1.06" is +10 m/s, and nozzle A3 having a scale factor to the minimum cross-sectional area of "1.14" is +0. From this fact, it can be seen that when the Laval nozzle is used in accordance with aspects of the invention, the neighborhood to the site where the cross-sectional area of the nozzle takes the minimum cross-sectional area is preferably the site where the cross-sectional area of the nozzle is not more than 1.1 times of the cross-sectional area in the axial direction of the nozzle.

Next, the supplying condition of the control gas will be described below.

Figure 3:
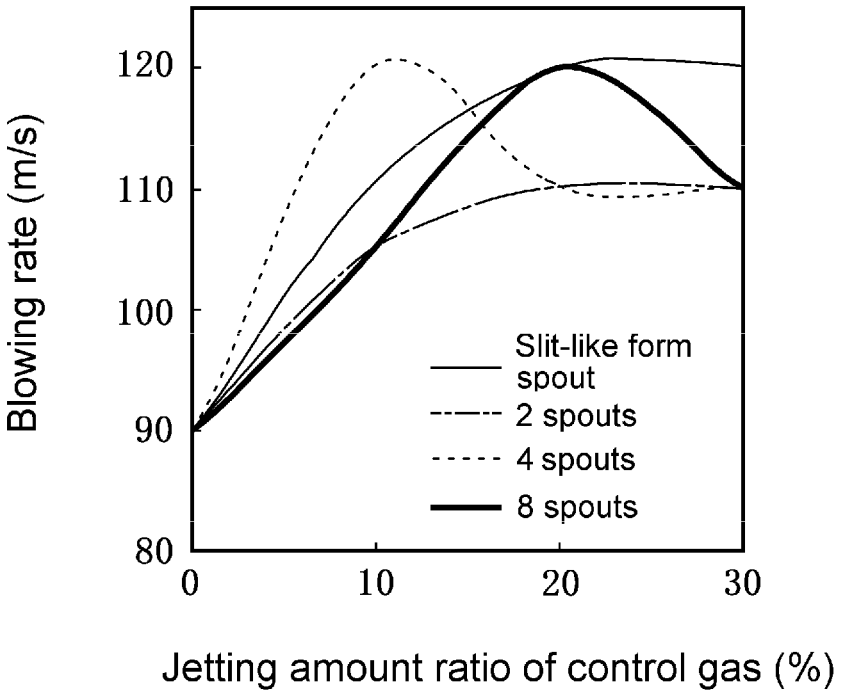
FIG. 3 is a graph showing a behavior of increase in a blowing rate by a jetting amount of a control gas in the blowing nozzles shown in FIGS. 2(*a*) to (*d*).

An examination is made on an influence of a jetting amount ratio of control gas (ratio of a jetting amount of the control gas to a total blowing amount of the gas) upon a blowing rate under a condition that the spout for the control gas is variously varied in a blowing nozzle having the same Laval nozzle form as in nozzle B of Table 1. Here, plural spout for control gas are arranged, as shown in FIGS. 2(*a*) to (*d*) so as to be in rotation symmetry with respect to the central axis of the blowing nozzle, by disposing 2, 4 or 8 spouts at an equal interval in the circumferential direction or by forming a spout in a slit-like form over the whole circumference. In the case of arranging the plural spouts, each spout is formed as an open end of the introduction hole for the control gas having an inner diameter of 1 mm. In the case of the slit-like formed spout, the width of the slit-like gap is 1 mm. The blowing rate on the central axis 200 mm away from the tip of each blowing nozzle is measured under a condition that the total gas blowing amount is set to a constant value of 1.1 $Nm^3$/min and the jetting amount ratio of the control gas is varied within a range of 0 to 30%. The measurement results of the blowing rate are shown in FIG. 3. As seen from FIG. 3, the effect on the blowing rate can be obtained in both cases that the spout for control gas is a slit-like form over the whole circumference and that the plural spouts are arranged. It is can be said that the jetting amount ratio of control gas is preferably not less than 5% to obtain the effect of apparently decreasing the cross-sectional area of the nozzle in the abovementioned throat portion in a certain level. Also, the upper limit of the jetting amount ratio of control gas is not particularly limited, but is preferably not more than 50%, more desirably not more than 30% to avoid an increase in size of the pathway for control gas or the supply system of control gas.

It can be seen that each nozzle shown in FIG. 3 has a jetting amount ratio of control with which the blowing rate takes the maximum. When the jetting amount ratio of control gas exceeds such a ratio, it may be observed that the blowing rate may tends to decrease. This is considered due to the fact that the jetting amount ratio of control gas substantially attaining the adequate expansion is provided from a relationship between the effect of substantially increasing the opening ratio larger than the actual nozzle form and the effect of raising the pressure of the main supply gas at the inlet of the throat portion caused by the introduction of the control gas.

Figure 4:
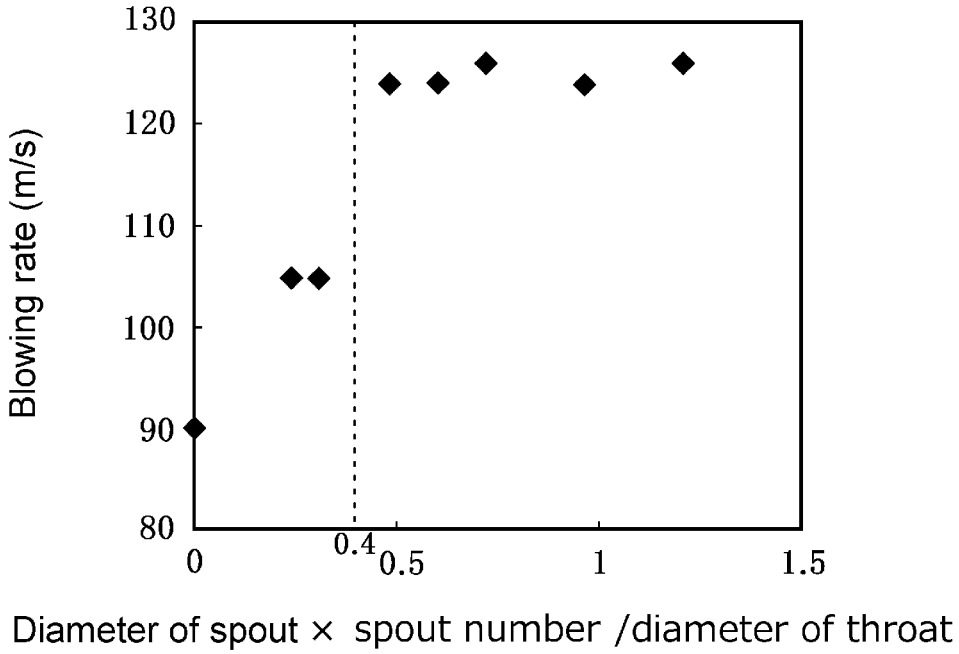
FIG. 4 is a graph showing results obtained by organizing the maximum gas blowing rate which takes the maximum with respect to a jetting amount ratio of control gas in a gas blowing nozzle used in a top-blowing lance according to aspects of the invention using a value of the diameter of a spout for control gas×the number of spouts for control gas/the diameter of a throat portion in the blowing nozzle as a horizontal axis.

Similarly, the measurement of the blowing rate is conducted, under a condition that 2 to 8 spouts for control gas are arranged at an equal interval in the circumferential direction and formed as an open end of an introduction hole for control gas having a circular section in the blowing nozzle having the same Laval nozzle form as in nozzle B in Table 1, by changing an inner diameter of the spout for control gas within a range of 0.8 to 1.2 mm to examine an influence of a ratio of zone having the spouts for control gas in the circumferential direction of the throat portion. FIG. 4 shows the results obtained by organizing a blowing rate at a jetting amount ratio of control gas that attains the maximum blowing rate under a condition that the total gas blowing amount is constant at 1.1 $Nm^3$/min with the value of the diameter of spout for control gas×the number of spouts for control gas/the diameter of throat portion in the blowing nozzle as an abscissa axis.

As seen from FIG. 4, the ratio of the zone where the spout exists in the circumferential direction of the throat portion (or a straight portion that the cross-sectional area of the nozzle takes the minimum in the axial direction of the nozzle) is preferably large to some extent, from a viewpoint of the effect of apparently decreasing the cross-sectional area of the nozzle in the throat portion. When the spout is arranged in plural directions on the side face in the circumferential direction of the blowing nozzle, therefore, it is preferable that total extension of the diameter of the spout (the diameter in a direction perpendicular to the central axis of the blowing nozzle and the central axis of the introduction hole for control gas or the diameter of the introduction hole for control gas to the spout) in the circumferential direction at the side face of the blowing nozzle, i.e. product of diameter of the spout and number n of the spouts per one blowing nozzle is not less than 0.4 times of an inner diameter of the nozzle in a site where the diameter or the cross-sectional area of the throat portion in the blowing nozzle takes the minimum.

Figure 5:
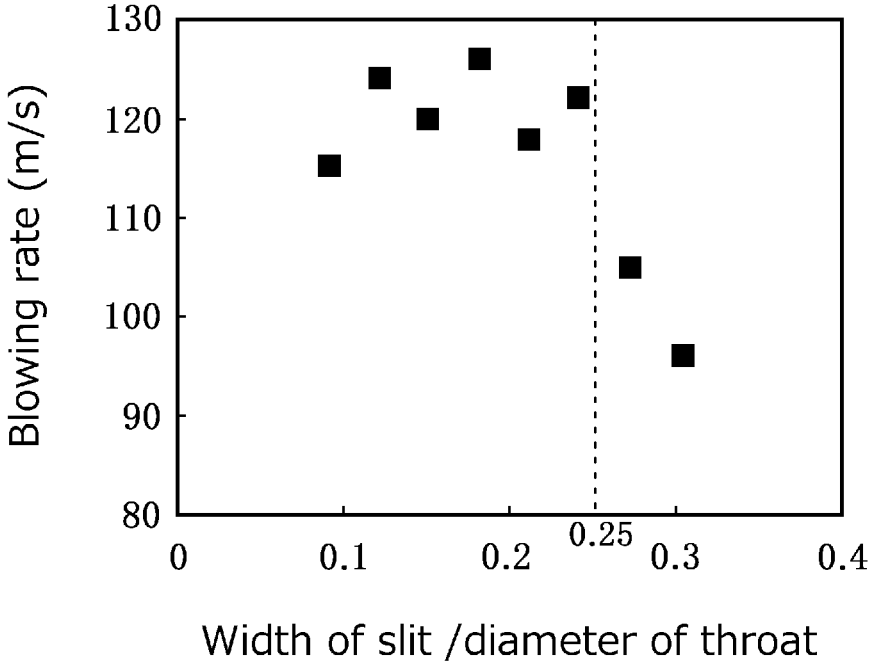
FIG. 5 is a graph showing results obtained by organizing the maximum gas blowing rate which takes the maximum with respect to a jetting amount ratio of control gas in a gas blowing nozzle used in a top-blowing lance according to aspects of the invention by using interval of gaps in slit/diameter of a throat portion in the blowing nozzle as a horizontal axis.

Another measurement of the blowing rate is conducted on a blowing nozzle having the same Laval nozzle form as in nozzle B of Table 1, under a condition that a spout for control gas is formed in a slit-like form over the whole circumferential direction of the blowing nozzle, by changing an interval of the gap in the slit within a range of 0.6 mm to 2.0 mm. FIG. 5 shows the measurement result by organizing the blowing rate at a jetting amount ratio of the control gas that attains the maximum blowing rate with the value of the interval of gap in the slit/diameter of throat portion in the blowing nozzle as an abscissa axis.

As seen from FIG. 5, when the spout is disposed in a slit-like form on the side face of the blowing nozzle over the whole circumferential direction thereof and further the length of the spout formed as a slit-like gap in the axial direction of the blowing nozzle is too long, the effect of increasing the blowing rate tends to be decrease. Therefore, the length of the spout formed in a slit-like form in the axial direction of the blowing nozzle is preferably not more than 0.25 times of the inner diameter of the blowing nozzle at a site where the cross-sectional area of the blowing nozzle takes the minimum. When the slit-like gap largely exceeds 0.25 times of the inner diameter of the blowing nozzle, the jetting amount of the control gas necessary for obtaining the effect of apparently decreasing the cross-sectional area of the nozzle at the throat portion is increased, which is not favorable in a point that the pathway of the control gas and the supply system of the control gas are necessary to be increased in size.

As shown in the cross-sectional view of the throat portion in FIGS. 2(*a*) to (*d*), the number of spouts is enough to be 2 or more or the spout may be arranged in a slit-like form over the whole circumferential direction of the nozzle. When the spouts are arranged unsymmetrically to the central axis of the blowing nozzle, however, there is a tendency that a gas jet blown from the blowing nozzle is deflected from the central axis, as disclosed in Patent Literature 3, and therefore it is desirable to arrange the spout so that at least part of one spout exists in each space formed by dividing the nozzle into two portions by an arbitrary plane passing through a central axis of the nozzle. In this case, it is desirable that the plural spouts are disposed at same position in the axial direction of the blowing nozzle from a viewpoint of the effect of apparently decreasing the cross-sectional area of the nozzle in the throat portion, but it is not strictly necessary at the same position in the axial direction of the nozzle. As long as the spouts are close to each other in the axial direction of the blowing nozzle and arranged such that at least part of one spout exists in each space formed by dividing the nozzle into two portions by an arbitrary plane passing through the central axis of the nozzle, the similar effect of the increasing the blowing rate can be obtained, thought the efficiency is poor as compared to a case that all of the spouts are arranged at same position in the axial direction of the blowing nozzle.

When the plural spouts for control gas are arranged on the side face of the nozzle in the circumferential direction as mentioned above, pathways for introducing the control gas into the plural spouts for control gas are communicated with each other in the top-blowing lance, whereby it is made possible to supply the control gas blown from each spout with good balance while simplifying the blowing amount control system or supply pathway of the control gas. More preferably, the introduction pathways for control gas are arranged through a circular gas pathway disposed around the blowing nozzle.

It is desirable that the whole part of the spout is included in the throat portion. However, the length of the throat portion may be short and smaller than the diameter of the spout in the axial direction of the nozzle. Even when a part of the spout is included in the widened portion located at the downstream side or in a tapered portion located at an upstream side (not shown), the similar effect can be obtained as long as the central position of the spout is included in the throat portion or the whole throat portion is included in the zone where the spout exists in the axial direction of the blowing nozzle, and a large difference is not caused in the function of controlling the blowing rate as mentioned later.

The effect of apparently decreasing the cross-sectional area of the nozzle by jetting the control gas from the side face of the nozzle is not necessarily limited to a case that the spout is disposed in a site where the cross-sectional area of the blowing nozzle strictly takes the minimum in the axial direction of the blowing nozzle. The effect of increasing the blowing rate can be obtained most efficiently when the spout is arranged at this site, and the similar effect of increasing the blowing rate may be obtained even when the spout is arranged in a site close to the site where the cross-sectional area takes the minimum in the axial direction of the blowing nozzle. However, as the cross-sectional area of the blowing nozzle at the position in the axial direction of the blowing nozzle where the spout is arranged becomes larger, a great amount of the control gas is necessary, which may lower the efficiency of increasing the blowing rate, so that it is desirable to arrange the spout in a site where the cross-sectional area is not more than 1.1 times of the minimum cross-sectional area.

In order to obtain the effect of apparently decreasing the cross-sectional area of the nozzle in the throat portion more effectively, it is desirable that a linear velocity (Nm/s) at the spout for control gas jetted toward inside of the blowing nozzle is large in a certain level. It preferably falls within the range of ½ times to 2 times with respect to a linear velocity of the main supply gas in the throat portion (an average value over the whole cross-section in the throat portion), whereby the effect of apparently decreasing the cross-sectional area of the nozzle in the throat portion can be obtained effectively without causing the pressure of the control gas to excessively increase. Among the findings obtained based on the above model test results with respect to the preferable conditions of providing the effect of increasing the blowing rate by the control gas, dimensionless indexes such as jetting amount ratio, length ratio, area ratio, linear velocity ratio and so on are sufficiently effective as long as the gas pressure or the linear velocity in the nozzle is in the similar range, even when a reduction scale or size thereof inclusive of an actual machine largely differs, so that the preferable range of the respective dimensionless index is applicable as it is.

The inventors have made various studies on a method wherein the generation amount of dust and the oxidation loss of iron are reduced by controlling the blowing rate or dynamic pressure of the gas jet using the top-blowing lance according to aspects of the invention while stably operating oxygen-blowing refining such as decarburization blowing in a convertor.

In general, the oxygen-blowing refining of iron steel is conducted for the purpose of desiliconization, decarburization, dephosphorization and the like. In the initial stage of the refining, impurity elements are removed efficiently by increasing a supply rate of oxygen, and thus the concentration of the impurity elements is lowered and unintended reaction such as formation of iron oxide or the like becomes dominant at the last stage of the refining. Accordingly, an oxygen-blowing pattern that decreases the supply rate of oxygen is frequently selected. When oxygen gas is supplied from the top-blowing lance, the kinetic energy of top-blown oxygen jet is changed in association with the above change of the oxygen-blowing rate, so that the impact state of the top-blown oxygen jet to molten slag or molten iron surface is changed, which may cause a fear that the reaction rate is influenced.

For example, when the supply rate of the top-blown oxygen gas is lowered at the last stage of the oxygen-blowing refining to suppress the formation of iron oxide in the decarburization refining of molten iron, the kinetic energy of the top-blown oxygen jet tends to be lowered to change agitation/mixed state in an impact position of the top-blown oxygen jet (hot spot) and decrease decarburization oxygen efficiency. In such a case, a method of lowering the lance height to suppress the decrease in the kinetic energy of the top-blown oxygen jet is also used, but it cannot be sufficiently handled because there is a limit to safety lance height.

In the oxygen-blowing refining method of molten iron according to aspects of the invention, the kinetic energy of the top-blown oxygen jet can be increased by adjusting the supply rate of the control gas in accordance with the supply rate of the oxygen-containing gas that is blown to molten iron through the top-blowing lance, which can increase the degree of freedom in the refining condition for obtaining the efficient reaction rate. For example, when the supply rate of the top-blown oxygen gas is decreased at the last stage of oxygen-blowing refining after 85% of the total oxygen gas amount is supplied in the decarburization refining of molten iron, the decrease of decarburization oxygen efficiency can be suppressed to suppress the formation of iron oxide more effectively by supplying oxygen gas as a main supply gas while jetting the control gas. In this case, the control gas is not supplied in the refining stage other than the last stage, whereby the excessive flying of molten iron or the formation of dust can be suppressed even in the previous refining stage at a high supply rate of oxygen gas while the efficient refining conditions can be maintained as a whole by varying the supply rate of the control gas in association with the procedure of the oxygen-blowing refining.

In order to verify the effect of increasing the blowing rate on the bath surface of molten iron to suppress the formation of iron oxide by supplying the control gas under the same condition of the total gas blowing amount and lance height, decarburization of molten pig iron is conducted with a top and bottom-blowing refining furnace on the scale of 2 t to examine an influence of the control gas upon a concentration of iron oxide in a slag. In the refining test of molten iron in a small-size furnace, conditions such as supplying amounts and rates of oxygen gas and refining agent per unit mass of molten iron, agitation power density (W/t) by the bottom-blown gas and so on are made approximately equal to those of the actual machine, whereby the test simulated to the refining reaction in the actual machine can be conducted. Under a condition of the oxygen gas blowing amount determined by the above case, the top-blowing lance is designed so as to render the range of the gas pressure or the linear velocity in the nozzle into the same level of those in the actual top-blowing lance or the abovementioned model test of the blowing nozzle. As to the condition of the lance height, a ratio of a depression depth to an iron bath depth is determined so as to be equal to the operation range of the actual machine by an empiric formula calculating a depression depth of molten iron.

Table 3 shows the conditions of the top-blowing lance used in this test. Two types of top-blowing lances, i.e. a single-hole lance D and a five-hole lance E each having a straight-type blowing nozzle are used, and four spouts for control gas are disposed in the blowing nozzle of each lance so as to be four-fold rotational symmetry to the central axis of the blowing nozzle. Under main test conditions shown in Table 4, decarburization treatment is conducted up to a low carbon concentration level under a condition of a constant total oxygen gas blowing amount while agitating the molten iron by bottom-blowing a small amount of argon gas. A relation between a carbon concentration (mass %) when the blowing is stopped at the end of the decarburization treatment and a T. Fe concentration in slag (mass %) is measured by comparing the case where no control gas is supplied with the case where the control gas is supplied in an amount corresponding to about 23% of the total oxygen gas blowing amount, and the measurement results are shown in Table 5 and FIG. 6.

TABLE 3

| Lance | D | E |
|---|---|---|
| Minimum diameter of blowing nozzle Dt (mm) | 13 | 6 |
| Outlet diameter of blowing nozzle De (mm) | 13 | 6 |
| Number of blowing nozzle | 1 | 5 |
| Inclination angle of blowing nozzle | 0° | 12° |
| Adequate expansion pressure Po (Mpa) | 0.19 | 0.19 |
| Lance height (mm) | 400 | 200 |
| Distance from spout for control gas to nozzle outlet (mm) | 13 | 6 |
| Diameter of spout for control gas (mm) | 3 | 1.4 |
| Number of spout for control gas | 4 | 4 each |
| Area ratio of spout for control gas | 21% | 22% |

TABLE 4

| | | |
|---|---|---|
| Amount of molten pig iron (t) | 2 | |
| Temperature of molten pig iron (° C.) | 1250-1300 | |
| Carbon concentration in molten pig iron (%) | 4.2 | |
| Bottom-blown gas amount ($Nm^3$/min) | 0.4 | |
| Top-blown gas amount ($Nm^3$/min) | 5.3 | |
| Condition of present invention | Main gas blowing amount ($Nm^3$/min) | 4.1 |
| | Control gas jetting amount ($Nm^3$/min) | 1.2 |
| Condition of Comparative Example | Main gas blowing amount ($Nm^3$/min) | 5.3 |
| | Control gas jetting amount ($Nm^3$/min) | 0 |

TABLE 5

| | | Carbon concentration at blowing stop(%) | T.Fe in slag (%) |
|---|---|---|---|
| Nozzle D | Invention Example | 0.02 | 22.0 |
| | | 0.03 | 19.3 |
| | | 0.05 | 16.5 |
| | | 0.10 | 14.7 |
| | Comparative Example | 0.02 | 23.8 |
| | | 0.03 | 22.2 |
| | | 0.05 | 19.2 |
| | | 0.10 | 16.5 |
| Nozzle E | Invention Example | 0.02 | 21.3 |
| | | 0.03 | 19.8 |
| | | 0.05 | 16.3 |
| | | 0.10 | 15.5 |
| | Comparative Example | 0.02 | 23.3 |
| | | 0.03 | 22.3 |
| | | 0.05 | 19.7 |
| | | 0.10 | 17.0 |

Figure 6:
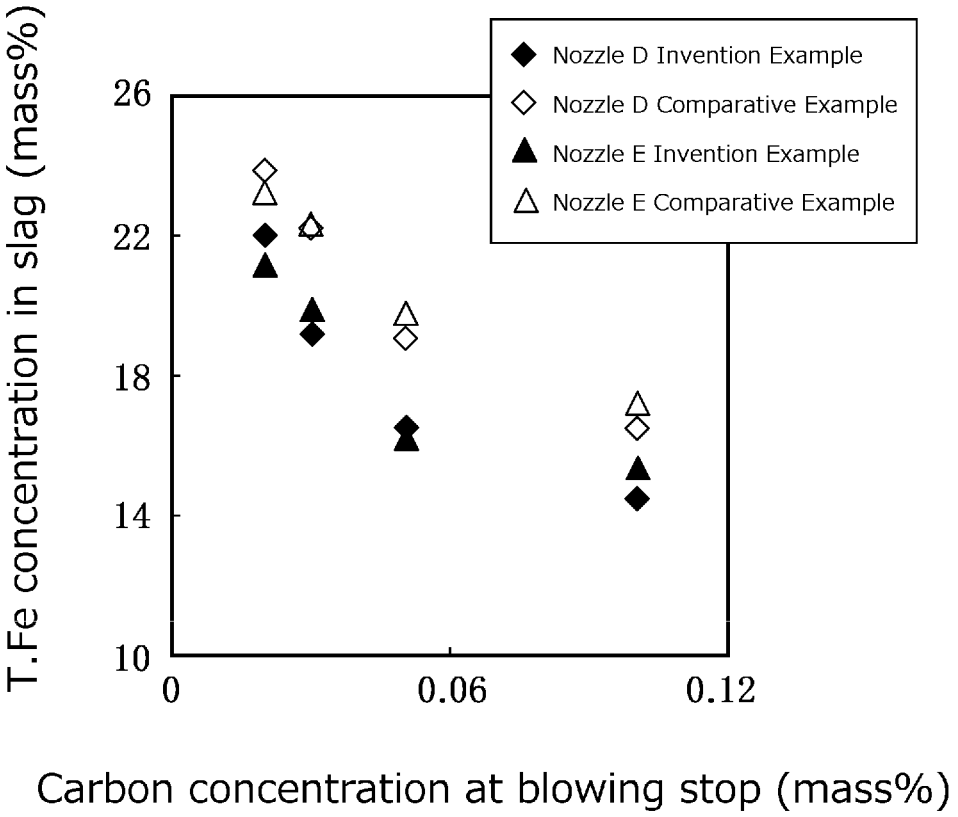
FIG. 6 is a graph showing a relation between a carbon concentration at the end of blowing and a T. Fe concentration (mass %) in a slag when decarburization treatment using a gas blowing nozzle for the top-blowing lance according to aspects of the invention is finished.

As seen from the results shown in Table 5 and FIG. 6, T. Fe in slag is relatively decreased to suppress oxidation loss of iron by jetting the control gas from the spout for control gas even under the same conditions of total gas blowing amount and lance height, as compared to the conventional technique using no control gas. This is considered due to the fact that the blowing rate at the impact of the oxygen gas jet onto iron bath is increased by the effect of the control gas to strengthen agitation force at hot spot. Although the control gas is supplied over the full blowing period in this test, it is known that the increase of the iron oxide concentration in the slag in decarburization refining is remarkable at the last stage of the refining, so that it is clear that the similar effect of suppressing the oxidation loss is obtained even when the control gas is supplied only at the last stage of the oxygen-blowing refining after the supply of about 85% of the total oxygen gas blowing amount, and it is effective to change the supply rate of the control gas in association with the progress of the oxygen-blowing refining.

A method of changing the supply rate of the control gas based on the result of the refining state detected during the oxygen-blowing refining is also effective. For example, it is effective to adopt a method of changing the supply rate of the control gas to adjust the formation rate of iron oxide from the result obtained by detecting a slag forming height or measuring decarburizing-oxygen efficiency based on analytical information of exhaust gas with time (for example, a method of starting the supply of the control gas to increase the kinetic pressure of top-blown oxygen gas jet in order to decrease the formation rate of iron oxide when the concentration of iron oxide in the slag is excessive) and the like.

Further, it is also effective to adjust the pattern of changing the supply rate of the control gas in accordance with the refining conditions such as temperature of molten iron, silicon concentration, carbon concentration, amount of scrap used and so on which are known before the start of the oxygen-blowing refining. For example, in the decarburization refining of molten iron having a silicon concentration of not less than 0.40 mass % before the start of oxygen-blowing refining, slopping tends to be easily caused at the initial stage of oxygen-blowing refining before 20% of the total oxygen gas amount contained in the oxygen-containing gas to be supplied is supplied under refining conditions of high oxygen blowing rate and high lance height. In this case, the oxygen-containing gas is supplied as the main supply gas while the control gas is jetted to increase kinetic pressure of the top-blown oxygen jet, whereby the excessive formation of iron oxide is suppressed to prevent the occurrence of slopping. In the decarburization refining of molten iron having a silicon concentration of less than 0.40 mass % before the start of oxygen blowing refining is mentioned a method of shifting kinetic pressure of the top-blown oxygen jet to a lower level without supplying the control gas at the initial stage of the oxygen-blowing refining to suppress flying of molten iron or formation of dust.

It is known that blowout of slag called as slopping may be caused when the silicon concentration in molten pig iron before blowing is high in the decarburization blowing in the converter. This results from the fact that when a great amount of silicon dioxide is produced at an initial blowing stage that dissolution of CaO-based solvent such as quicklime or the like into liquid phase slag (slag formation) is not advanced so much, a phenomenon that CO bubbles generated in the decarburization reaction are retained in a great amount of high-viscosity molten slag to increase the apparent volume by about 10 times (slag forming) is rapidly advanced. Especially, when the thickness of the slag is increased by forming, there is a tendency that the top-blown oxygen jet is reduced to change the impact state onto molten pig iron or slag, whereby the ratio of oxygen consumed in the oxidation of iron is increased to bring about increase in the iron oxide concentration in the slag. When the iron oxide concentration in the slag is increased, fine CO bubbles formed in the slag is increased by the reaction with carbon in molten iron bath or in molten iron droplets in the slag to promote the forming, and hence the forming is advanced at an accelerated pace to cause slopping.

As a method of preventing such a slopping is considered a method wherein the lance height is lowered in accordance with the forming height of the slag to ensure kinetic pressure of the top-blown jet that impacts onto molten iron bath and thereby suppress the excessive formation of iron oxide. However, it is inadvisable to lower the lance height under the blowing condition such as high oxygen-blowing rate at the initial blowing stage, which may cause a high risk that the top-blowing lance is damaged by the flying molten iron to increase frequency of repair or operation trouble is caused by water leakage. Since slopping is a factor that largely inhibits the operation, when the silicon concentration in molten pig iron before blowing is high, the oxygen blowing rate at the initial blowing stage is decreased to a lower level to suppress the slopping. However, decreasing the oxygen blowing rate causes the prolongation of the blowing time. Thus, the inventors have examined an influence of the silicon concentration in molten pig iron before blowing and the jetting amount ratio of control gas supplied to the nozzle upon the slopping, under a condition that the oxygen blowing rate is not decreased at the initial blowing stage.

In top and bottom-blowing refining equipment on the scale of 2 t, decarburization treatment is conducted on molten pig iron having various silicon concentrations to examine an influence of control gas upon a generation state of slopping, a generation state of dust and a T. Fe concentration in the slag. The basic test conditions other than the jetting amount of the control gas are the same as shown in Table 4, and the silicon concentration in molten pig iron before the decarburization treatment is varied within the range of 0.1 to 0.5 mass %. The decarburization treatment is conducted until the carbon concentration lowers to about 0.05 mass % by using the same top-blowing lance as lance E in Table 3 and variously changing the jetting amount ratio of the control gas under the condition that the total oxygen blowing amount is constant.

Figure 7:
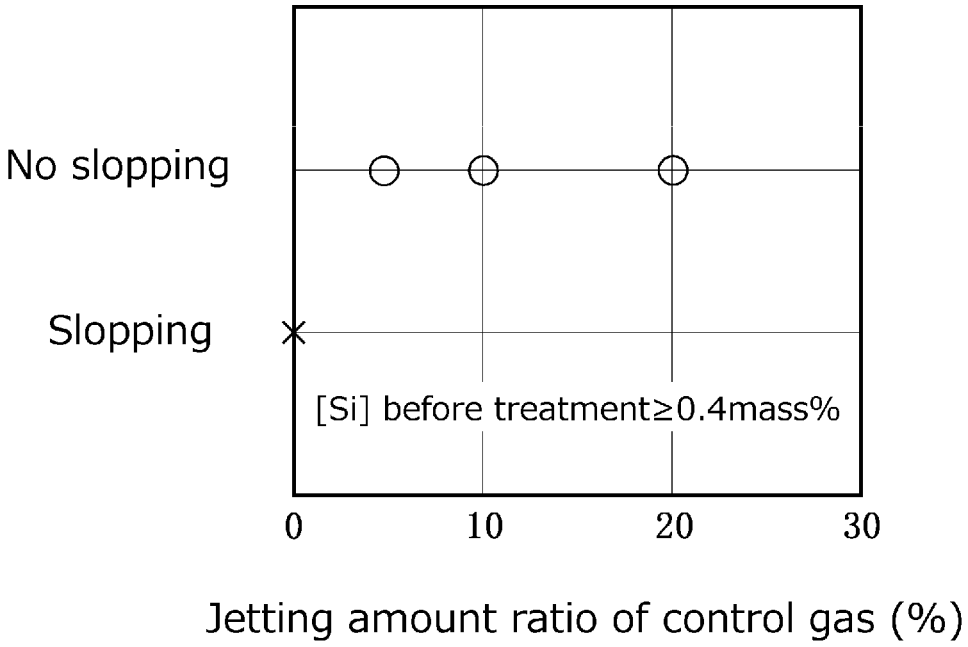
FIG. 7 is a graph showing results of presence or absence of slopping generation by a jetting amount ratio of control gas at an initial blowing stage in decarburization blowing used in accordance with aspects of the invention.

FIG. 7 shows the results of the presence or absence of generation of slopping with respect to a jetting amount ratio of control gas at the initial blowing stage in the decarburization blowing of molten pig iron having a silicon concentration before the blowing of not less than 0.4 mass %. The generation of slopping is not observed in the decarburization blowing of molten pig iron having a silicon concentration of less than 0.4 mass %. As seen from these results, in the case of the decarburization blowing of molten pig iron having a silicon concentration before the blowing of not less than 0.4 mass %, it is possible to suppress the slopping at the initial blowing stage by supplying the control gas from the spout for control gas disposed in the oxygen gas blowing nozzle of the top-blowing lance at the initial blowing stage under a proper condition.

Figure 8:
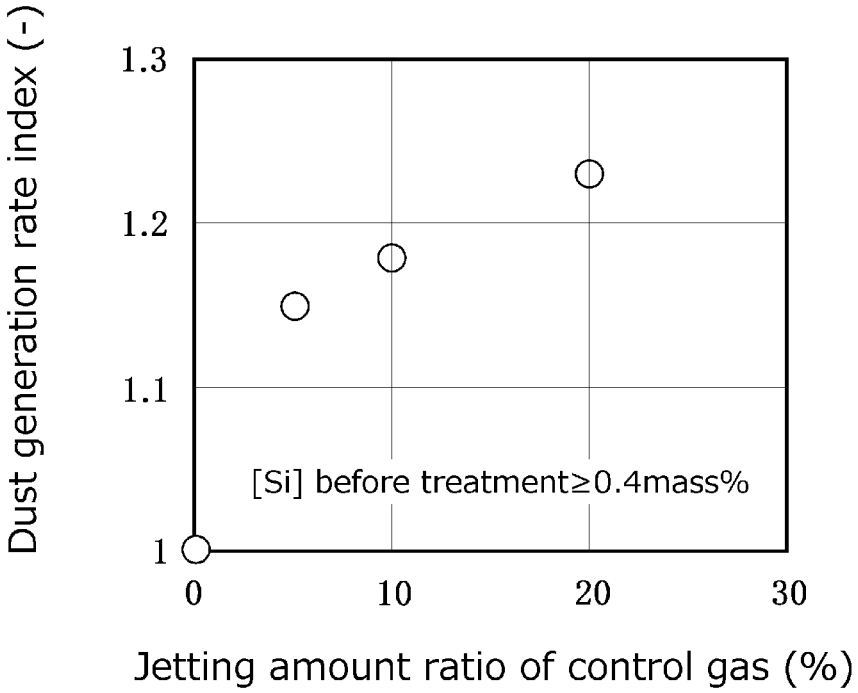
FIG. 8 is a graph showing a relation between a jetting gas amount ratio of control gas and a dust generation rate under a condition that a silicon concentration in molten pig iron is less than 0.4 mass % in decarburization blowing according to aspects of the invention.

FIG. 8 shows a relation between a jetting amount ratio of control gas and a dust generation rate under a condition that a silicon concentration in molten pig iron is less than 0.4 mass %. It can be seen that the dust generation rate tends to increase as the jetting amount ratio of control gas is increased. The dust in the decarburization refining mainly results from fine liquid droplets produced associated with the breakage of CO bubbles (bubble burst). In particular, it is known that the generation rate is large at the prime stage of decarburization from the initial stage to the middle stage of the decarburization treatment. As the blowing rate of the oxygen gas jet is increased by supplying the control gas, the droplets of molten iron flying physically are increased, and the dust generation rate secondarily produced by bubble burst is increased or the gas blowing rate is increased, whereby it is considered that the ratio of dust carried off toward the outside of the furnace is increased to increase the dust generation rate. In the decarburization treatment of molten pig iron having a silicon concentration, which is decreased by a preliminary treatment, the dust generation rate tends to be increased because the generation amount of cover slag is small. Therefore, in the decarburization treatment of molten pig iron having a silicon concentration of less than 0.4 mass %, it can be said desirable to perform blowing without supplying the control gas at the prime stage of the decarburization to avoid increase of the dust generation rate.

Figure 9:
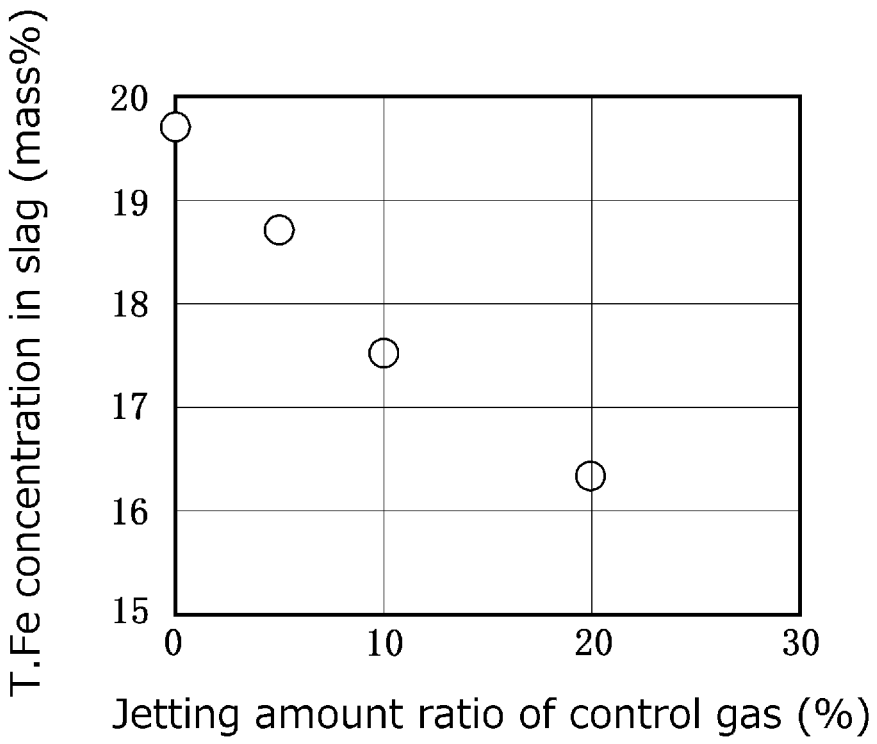
FIG. 9 is a graph showing a relation between a T. Fe concentration (mass %) in a slag and a jetting amount ratio of control gas at a time of conducting decarburization blowing up to a carbon concentration of about 0.05 mass %.

FIG. 9 shows a relation between a T. Fe concentration in the slag (mass %) and a jetting amount ratio of control gas at a time of conducting decarburization blowing until a carbon concentration reaches about 0.05 mass % in the decarburization treatment of molten pig iron having a silicon concentration of less than 0.4 mass %. It can be seen that T. Fe in the slag is decreased by supplying the control gas under proper conditions to suppress oxidation loss of iron. There is a similar tendency in the decarburization treatment of molten pig iron having a silicon concentration of not less than 0.4 mass %, from which it is considered that the blowing rate of oxygen gas jet is increased by the effect of the control gas to strengthen the agitation force at hot spot.

As seen from the above knowledge, at the initial stage of oxygen-blowing refining before 20% of the total oxygen gas amount is supplied and at the last stage of oxygen-blowing refining after 85% of the total oxygen gas amount is supplied in the decarburization treatment of molten pig iron having a silicon concentration of not less than 0.4 mass %, it is preferable to adopt a refining method of supplying the control gas from the spout for control gas disposed in the oxygen gas blowing nozzle of the top-blowing lance under proper conditions to relatively increase the blowing rate of the oxygen gas jet while supplying no control gas at the other stage.

At the last stage of oxygen-blowing refining after 85% of the total oxygen gas amount is supplied in the decarburization treatment of molten pig iron having a silicon concentration of less than 0.4 mass %, it can be said preferable to adopt a refining method of supplying the control gas from the spout for the control gas disposed in the oxygen gas blowing nozzle of the top-blowing lance under proper conditions to relatively increase the blowing rate of the oxygen gas while supplying no control gas at the other stages.

EXAMPLES

There will be described an example of actually applying the oxygen-blowing refining method of molten iron according to aspects of the invention to an industrial-scale decarburization treatment in a converter.

In top and bottom blowing converter equipment on a scale of 300 t, decarburization treatment of molten pig iron is conducted by variously changing the specifications of a blowing nozzle in a top-blowing lance to examine an influence thereof upon the dust generation amount, iron yield and slopping generation state. Molten pig iron is tapped from a blast furnace into a torpedo car previously charged with iron scrap containing heavy scraps and transferred to a steelmaking factory, where a given amount of the molten pig iron is discharged to a molten pig iron ladle to conduct desulfurization treatment by using a mechanical-agitation type desulfurization device for molten pig iron. After slag subjected to the desulfurization treatment is discharged from the molten pig iron ladle, the molten pig iron is charged onto a converter previously containing about 30 tons of iron scrap to conduct decarburization treatment. A total charging amount of the molten pig iron and iron scrap per one blowing is about 300 tons, and the temperature of the molten pig iron at the charging to the converter is 1280 to 1320° C., and the silicon concentration is 0.20 to 0.60 mass %, and the carbon concentration is 4.0 to 4.4 mass %.

The total oxygen amount supplied by blowing and addition amounts of heating material and cooling material are determined based on static control from information such as the amount, temperature, silicon concentration, and carbon concentration of the charged molten pig iron, the amount of the charged iron scrap, and the target temperature and carbon concentration of molten steel and so on. Also, addition amounts of auxiliary materials such as quicklime and the like are determined so that a calculated basicity of the slag after the decarburization treatment (CaO mass %/$SiO_2$ mass %) is 3.5 and added at a time in the initial blowing stage. In this case, a formation amount of the slag is adjusted in accordance with a target phosphorus concentration of molten steel as required.

The total oxygen supply rate and the lance height (distance from a static bath surface of molten iron to the leading end of a lance) in the decarburization blowing are 750 $Nm^3$/min (2.5 $Nm^3$/(min·t)) and 4.0 m, respectively, in a period from the initial stage to the middle stage other than the last stage of the blowing, and also 450 $Nm^3$/min (1.5 $Nm^3$/(min·t)) and 2.5 m, respectively, at the last stage of the blowing after the supply of 85% of the total oxygen amount that is determined based on the static control. Each lance height is a value set as a lower limit of a stably operable lance height without causing a large difference in the damage state of the top-blowing lance at the respective total oxygen supply rate based on the past operation performance using lance F. Also, argon gas is bottom-blown at 30 $Nm^3$/min (0.10 $Nm^3$/min·t)) from plural gas blowing plugs disposed in the bottom of the converter over a whole blowing period.

In the last blowing stage, the oxygen amount and the addition amount of a cooling material to be supplied after the measurement are determined based on the temperature and carbon concentration of molten steel measured by using a sub-lance. The blowing is stopped when the supply of the determined oxygen amount is finished, and molten steel is tapped into a ladle. The molten steel is then subjected to ladle refining with a RH degassing apparatus or a bubbling device to adjust the chemical composition and temperature thereof, and then supplied to a continuous casting apparatus to conduct continuous casting of slab and the like.

Table 6 shows conditions of eight top-blowing lances used in the test.

TABLE 6

| Lance | F | G | H | I | J | K | L | M |
|---|---|---|---|---|---|---|---|---|
| Minimum diameter of blowing nozzle Dt(mm) | 62 | 66 | 70 | 66 | 70 | 70 | 70 | 70 |
| Outlet diameter of blowing nozzle De(mm) | 70 | 70 | 70 | 70 | 70 | 70 | 70 | 70 |
| Length of throat (mm) | 20 | 20 | 20 | 20 | 20 | 20 | 20 | 20 |
| Length of widened portion(mm) | 60 | 60 | 60 | 60 | 60 | 60 | 60 | 60 |
| Number of blowing nozzle | 5 | 5 | 5 | 5 | 5 | 5 | 5 | 5 |
| Inclination angle of blowing nozzle | 12° | 12° | 12° | 12° | 12° | 12° | 12° | 12° |

TABLE 6-continued

| Lance | F | G | H | I | J | K | L | M |
|---|---|---|---|---|---|---|---|---|
| Adequate expansion pressure Po (Mpa) | 0.45 | 0.33 | 0.19 | 0.33 | 0.19 | 0.19 | 0.19 | 0.19 |
| Distance from spout for control gas to nozzle outlet (mm) | — | — | — | 70 | 70 | 70 | 70 | 70 |
| Diameter of spout for control gas(mm) | — | — | — | 10 | 10 | 3 | 6 | 10 |
| Number of spout for control gas | — | — | — | 8 | 8 | slit-like | 4 | slit-like |
| Area ratio of spout for control gas | — | — | — | 18% | 16% | 17% | 3% | 57% |
| Jetting amount ratio of control gas | 0 | 0 | 0 | 20% | 20% | 20% | 5% | 30% |

Lance F is a top-blowing lance having a Laval nozzle used in the conventional operation. Lance G and lance H are prepared by changing the blowing nozzle form of lance F for the purpose of suppressing loss due to flying iron and dust generation by decreasing the blowing rate of the gas jet when a great amount of oxygen is blown. The throat size of lance G is enlarged to 66 mm, and a straight-type blowing nozzle having an inner diameter of 70 mm is used in lance H. In this respect, it is difficult to enlarge the outlet diameter of the blowing nozzle larger than 70 mm, in view of ensuring the water-cooling structure required in the top-blowing lance.

Lance I and lance J are top-blowing lances of Invention Examples prepared by providing 8 spouts for control gas formed as an open end of an introduction hole for control gas having a circular section with an inner diameter of 10 mm, at a throat portion of each blowing nozzle of the lance G and at a position of 70 mm from an outlet of each blowing nozzle of the lance H, respectively, such that the spouts are arranged equally in the circumferential direction of the inner face of the blowing nozzle. Lances K to M are top-blowing lances of Invention Examples prepared by arranging spouts for control gas of different forms in a position of 70 mm from the outlet of the each blowing nozzle of lance H. Lance K and lance M are provided with a slit-like spout for control gas having a gap of a width of 3 mm and 10 mm, respectively, over the whole circumference of the inner face of each blowing nozzle. Lance N is provided with 4 spouts for control gas formed as an open end of an introduction hole for control gas having a circular section with an inner diameter of 6 mm in the inner face of each blowing nozzle so as to be arranged equally in the circumferential direction of the inner face of the blowing nozzle.

The introduction pathways of control gas toward the spouts for control gas in each blowing nozzle of each lance are communicated with each other in the lance, and industrially pure oxygen gas is supplied as the control gas in the predetermined jetting amount from a supply device for control gas. When the control gas is blown using any top-blowing lance, a jetting amount ratio of control gas (ratio of control gas weight to total gas blowing amount) is set as shown in Table 6.

There will be described below a generation state of slopping in the use of each top-blowing lance, and an operation method determined in association therewith.

When lance F is used, slopping is not caused in such a manner the operation is disturbed, while a relatively large slopping may be caused when the silicon concentration of the molten pig iron is not less than 0.50 mass % in the lance G or when the silicon concentration of molten pig iron is not less than 0.40 mass % in the lance H, whereby it is difficult to continue the stable operation. Thus, the operation using lance G is continued such that the silicon concentration of molten pig iron charged into the converter is limited to less than 0.50 mass % by the preliminary desiliconization treatment in the torpedo car or the use of a bath mixed with molten pig metal having a low silicon concentration. In the operation using lance I, which has the same blowing nozzle form as lance G, the control gas is supplied when the silicon concentration of the molten pig iron charged into the converter is not less than 0.50 mass % while the control gas is not supplied when the silicon concentration of molten pig iron charged into the converter is less than 0.50 mass %, in the initial blowing stage before 20% of total oxygen amount determined by static control is supplied. The operation using lance H is continued in such a manner that the silicon concentration of the molten pig iron charged into the converter is similarly limited to less than 0.40 mass %. In the operations using lances J to M having the same blowing nozzle form as lance H, the control gas is supplied when the silicon concentration of the molten pig iron charged into the converter is not less than 0.40 mass % while the control gas is not supplied when the silicon concentration of the molten pig iron charged into the converter is less than 0.40 mass %, at the initial blowing stage until 20% of the total oxygen amount determined by the static control is supplied. In this case, the ratio of molten iron subjected to the preliminary desiliconization in the operation with lance G and the ratio of the charging when the silicon concentration of molten pig iron charged into the converter is not less than 0.50 mass % in the operation using lance I are both about ten percent.

The operation using the lance H is continued also in such a manner that the silicon concentration of the molten pig iron charged into the converter is limited to less than 0.40 mass %. In the operation using lances J to M having the same blowing nozzle form as lance H, the control gas is supplied when the silicon concentration of the molten pig iron charged into the converter is not less than 0.40 mass % while the control gas is not supplied when the silicon concentration of the molten pig iron charged into the converter is less than 0.40 mass %, at the initial blowing stage before 20% of the total oxygen amount determined based on the static control is supplied. In this case, a ratio of the molten pig iron subjected to the preliminary desiliconization in the operation using lance H and a ratio of the charging when the silicon concentration of the molten pig iron charged into the converter is not less than 0.40 mass % in the operation using lances J to M are both about forty percent.

In the operation using a lance having any type of spout for control gas, blowing is conducted such that the total oxygen supply rate is decreased while the control gas is supplied at the last blowing stage after 85% of the total oxygen amount determined based on the static control is supplied. In the operation during the period other than the initial blowing stage and the last blowing stage, the control gas is not supplied even in the case of using the lance having any type of spout for control gas.

Table 7 shows the evaluation results of average values of a dust generation amount and iron yield per one blowing (unit consumption) when the blowing of about 200 times is conducted every top-blowing lance. The dust generation amount is an average unit consumption determined from the amount of collected dust generated in the period when each top-blowing lance is used. The iron yield is determined from the total of a product amount and rejection amount generated in the process up to continuous casting, and a base metal amount recovered for recycling. Table 7 also shows a back pressure of the blowing nozzle in each lance under oxygen-blowing conditions at the initial and last blowing stages (supply pressure of main supply gas to lance) and an average (T. Fe) value in the slag when the carbon concentration of molten steel at the end of the blowing is 0.04 to 0.05 mass %. The numerical value in a parenthesis in the column of back pressure of main supply gas (initial stage) in Table 7 is a value of a case when the control gas is not supplied.

TABLE 7

| Lance | Blowing nozzle | Spout for control gas | Back pressure of main supply gas (initial stage) (Mpa) | Back pressure of main supply gas (last stage)(Mpa) | Dust generation amount (kg/t) | Iron yield (%) | (T. Fe) in slag (mass %) | Remarks | |
|---|---|---|---|---|---|---|---|---|---|
| F | ϕ 62-70 Laval | Absence | 0.50 | 0.30 | 11.8 | — | 19.2 | | Comparative Example |
| G | ϕ 66-70 Laval | Absence | 0.44 | 0.27 | 11.0 | +0.20 | 21.9 | [Si] < 0.50% | Comparative Example |
| H | ϕ 70 straight | Absence | 0.39 | 0.24 | 10.6 | +0.22 | 23.5 | [Si] < 0.40% | Comparative Example |
| I | ϕ 66-70Laval | ϕ 10 × 8 | 0.51 (0.44) | 0.32 | 10.9 | +0.21 | 18.3 | | Invention Example |
| J | ϕ 70 straight | ϕ 10 × 8 | 0.45 (0.39) | 0.28 | 9.9 | +0.23 | 19.6 | | Invention Example |
| K | ϕ 70 straight | 3 mm slit | 0.45 (0.39) | 0.28 | 9.7 | +0.25 | 19.3 | | Invention Example |
| L | ϕ 70 straight | ϕ 6 × 4 | 0.44 (0.39) | 0.27 | 9.4 | +0.14 | 20.5 | | Invention Example |
| M | ϕ 70 straight | 10 mm slit | 0.43 (0.39) | 0.26 | 10.2 | +0.16 | 20.8 | | Invention Example |

As seen from Table 7, the dust generation amount is decreased in the operation using lance G or H as compared to lance F, but the effect of increasing the iron yield is diminished by the increase in the iron oxide concentration in the slag. The operation using lance G or H, where the preliminary desiliconization treatment of molten pig iron may be necessary, is not favorable because endotherm is caused by decomposition of iron oxide contained in the desiliconization agent.

Contrary to this, in the Invention Examples, it is possible to prevent slopping by supplying control gas when needed, to increase the rate of top-blown oxygen jet without conducting preliminary treatment of molten pig iron. Accordingly, the blowing rate is decreased to suppress dust generation when the rate of top-blown oxygen is not necessary to be increased, while the increase of iron oxide concentration in the slag can be suppressed by supplying the control gas at the last blowing stage, so that it is possible to stably continue the operation capable of increasing the iron yield. Since the iron oxide concentration in the slag can be lowered in the above operation, there is another advantage that an alloying iron for deoxidation or the like can be saved. In the operation using lances L or M, the iron oxide concentration in the slag has a tendency to increase as compared to the other Invention Examples, so that the effect of improving the iron yield is decreased, but the effect of reducing the dust generation amount and the effect of improving the iron yield are clearly obtained as compared to the conventional operation using lance F.

INDUSTRIAL APPLICABILITY

Although the decarburization blowing is explained in the above examples, the invention is not limited to these examples, and the lance may be used in the dephosphorization blowing or desiliconization blowing. Also, as long as the refining process is performed with an oxygen-blowing lance, aspects of the invention are applicable to refining in an electric furnace. In particular, it is effective when it is intended to increase the blowing rate or kinetic pressure irrespectively of the change of other gas supplying conditions. For example, when the supplying rate of top-blown oxygen gas is decreased in accordance with the decrease of dephosphorization oxygen efficiency at the last refining stage in the preliminary dephosphorization treatment of molten pig iron using a converter type refining furnace, the decrease of the dephosphorization reaction efficiency can be suppressed by applying the oxygen-blowing refining method according to aspects of the invention of suppressing the decrease of the top-blowing rate by using the control gas.

REFERENCE SIGNS LIST

1 throat portion
2 widened portion
3 spout
4 air storing tank

The invention claimed is:

1. A method for oxygen-blowing refining of molten iron by blowing an oxygen-containing gas from a top-blowing lance onto molten iron charged in a reaction vessel to conduct oxygen-blowing refining of the molten iron, characterized in that the oxygen-containing gas as a main supply gas is supplied from an inlet side of a blowing nozzle for the oxygen-containing gas passing through an outer shell of the top-blowing lance and blown from the blowing nozzle while a control gas is jetted toward inside of the blowing nozzle for at least a part of a period of the oxygen-blowing refining from a spout arranged in a side face of the blowing nozzle at a site where a cross-sectional area of the blowing nozzle takes the minimum in the axial direction of the blowing nozzle or a neighborhood thereof so that at least a part of the spout exists in each space formed by dividing the blowing nozzle into two by an arbitrary plane passing through a central axis of the blowing nozzle, wherein the neighborhood of the site where the cross-sectional area of the blowing nozzle takes the minimum in the axial direction of the blowing nozzle is a site where the cross-sectional area of the blowing nozzle is not more than 1.1 times of the minimum cross-sectional area in the axial direction of the nozzle, and wherein a pressure of the main supply gas at the inlet side of the blowing nozzle is made larger than an adequate expansion pressure Po satisfying the following equation (1):

$$Ae/At=(5^{5/2}/6^3)\times(Pe/Po)^{-5/7}\times[1-(Pe/Po)^{2/7}]^{-1/2} \quad (1),$$

wherein At is a minimum cross-sectional area of the blowing nozzle ($mm^2$), Ae is a cross-sectional area of an outlet of the blowing nozzle ($mm^2$), Pe is a pressure in an atmosphere at an outlet of the blowing nozzle (kPa) and Po is an adequate expansion pressure of the blowing nozzle (kPa).

2. The method for oxygen-blowing refining of the molten iron according to claim 1, wherein the blowing nozzle is a straight nozzle having a straight portion continuous to the outlet of the blowing nozzle where the cross-sectional area is minimum and constant in the axial direction of the blowing nozzle or is a Laval nozzle having a widened portion continuous to a throat portion where the cross-sectional area takes the minimum in the axial direction of the blowing nozzle.

3. The method for oxygen-blowing refining of the molten iron according to claim 1, wherein the spout comprises a plurality of spouts arranged at plural places in a side face of the blowing nozzle in a circumferential direction thereof and a product of a diameter of an introduction hole for the control gas toward the spouts and the number of the spouts n per one blowing nozzle is not less than 0.4 times of an inner diameter of the blowing nozzle at the site where the cross-sectional area of the blowing nozzle takes the minimum.

4. The method for oxygen-blowing refining of the molten iron according to claim 1, wherein the spout is arranged in a slit form over the whole circumferential direction at a side face of the blowing nozzle and a length of the spout in the axial direction of the blowing nozzle is not more than 0.25 times of an inner diameter of the blowing nozzle at the site where the cross-sectional area of the blowing nozzle takes the minimum.

5. The method for oxygen-blowing refining of the molten iron according to claim 1, wherein the amount of the control gas jetted toward inside of the blowing nozzle for at least part of a period of the oxygen-blowing refining is not less than 5% of a total amount of the control gas and the main supply gas supplied to the blowing nozzle.

6. The method for oxygen-blowing refining of the molten iron according to claim 1, wherein a supply rate of the control gas is adjusted in accordance with a supply rate of the oxygen-containing gas blown from the top-blowing lance to the molten iron.

7. The method for oxygen-blowing refining of the molten iron according to claim 1, wherein the supply rate of the control gas is varied with the progression of the oxygen-blowing refining of the molten iron.

8. The method for oxygen-blowing refining of the molten iron according to claim 1, wherein the supply rate of the control gas is varied in accordance with a silicon concentration in the molten iron before the start of the oxygen-blowing refining.

9. The method for oxygen-blowing refining of the molten iron according to claim 1, wherein the oxygen-containing gas is supplied as the main supply gas while the control gas is jetted in the blowing nozzle at a last stage of the oxygen-blowing refining after the supply of 85% of a total oxygen gas amount in the oxygen-containing gas fed in the oxygen-blowing refining.

10. The method for oxygen-blowing refining of the molten iron according to claim 1, wherein the oxygen-containing gas is supplied as the main supply gas to the molten iron having a silicon concentration of not less than 0.40 mass % before the start of the oxygen-blowing refining while the control gas is jetted in the blowing nozzle at an initial stage of the oxygen-blowing refining before the supply of 20% of a total oxygen gas amount contained in the oxygen-containing gas fed in the oxygen-blowing refining.

11. A top-blowing lance for blowing an oxygen-containing gas to molten iron charged in a reaction vessel, characterized in that a blowing nozzle for the oxygen-containing gas is provided so as to pass through an outer shell of the top-blowing lance;

a spout for jetting a control gas toward inside the blowing nozzle is arranged in a side face of the blowing nozzle at a site where a cross-sectional area of the blowing nozzle takes the minimum in the axial direction of the blowing nozzle or a neighborhood thereof so that at least part of the spout exists in each space formed by dividing the blowing nozzle into two by an arbitrary plane passing through a central axis of the blowing nozzle; and introduction pathways for the control gas into plural spouts for the control gas arranged in plural directions in the circumferential direction of a side face of the blowing nozzle are communicated to each other in the top-blowing lance, wherein the neighborhood of the site where the cross-sectional area of the blowing nozzle takes the minimum in the axial direction of the blowing nozzle is a site where the cross-sectional area of the blowing nozzle is not more than 1.1 times of the minimum cross-sectional area in the axial direction of the blowing nozzle, and wherein the spout comprises a plurality of spouts arranged at plural places in the side face of the blowing nozzle in a circumferential direction thereof and the product of an inner diameter of a jetting nozzle for the control gas communicating with the spouts and number of the spouts n per one blowing nozzle is not less than 0.4 times of an inner diameter of the blowing nozzle corresponding to the minimum cross-sectional area of the blowing nozzle.

12. A top-blowing lance for blowing an oxygen-containing gas to molten iron charged in a reaction vessel, characterized in that a blowing nozzle for the oxygen-containing gas is provided so as to pass through an outer shell of the top-blowing lance, and a spout for jetting a control gas toward inside the blowing nozzle is arranged in a slit form over the whole circumferential direction at a side face of the blowing nozzle at a site where a cross-sectional area of the blowing nozzle takes the minimum in the axial direction of the blowing nozzle or a neighborhood thereof, wherein the neighborhood of the site where the cross-sectional area of the blowing nozzle takes the minimum in the axial direction of the blowing nozzle is a site where the cross-sectional area of the blowing nozzle is not more than 1.1 times of the minimum cross-sectional area in the axial direction of the blowing nozzle, and wherein a length of the spout in the axial direction of the blowing nozzle is not more than 0.25 times of an inner diameter of the blowing nozzle corresponding to the minimum cross-sectional area of the blowing nozzle.

13. The top-blowing lance according to claim 11, wherein the blowing nozzle is a straight nozzle having a straight portion continuous to the outlet of the blowing nozzle where the cross-sectional area is minimum and constant in the axial direction of the blowing nozzle or is a Laval nozzle having a widened portion continuous to a throat portion where the cross-sectional area takes the minimum in the axial direction of the blowing nozzle.

14. The top-blowing lance according to claim 12, wherein the blowing nozzle is a straight nozzle having a straight portion continuous to the outlet of the blowing nozzle where the cross-sectional area is minimum and constant in the axial direction of the blowing nozzle or is a Laval nozzle having a widened portion continuous to a throat portion where the cross-sectional area takes the minimum in the axial direction of the blowing nozzle.

* * * * *